US009329527B2

(12) United States Patent
Morita

(10) Patent No.: US 9,329,527 B2
(45) Date of Patent: May 3, 2016

(54) TONER CASE AND IMAGE FORMING APPARATUS INCLUDING THE SAME

(71) Applicant: KYOCERA Document Solutions Inc., Osaka-shi, Osaka (JP)

(72) Inventor: Takashi Morita, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/810,312

(22) Filed: Jul. 27, 2015

(65) Prior Publication Data

US 2016/0033896 A1 Feb. 4, 2016

(30) Foreign Application Priority Data

Jul. 30, 2014 (JP) ..... 2014-155579
Jul. 30, 2014 (JP) ..... 2014-155580

(51) Int. Cl.
*G03G 15/08* (2006.01)

(52) U.S. Cl.
CPC ..... *G03G 15/0865* (2013.01)

(58) Field of Classification Search
CPC ..... G03G 15/0865; G03G 15/0877; G03G 15/0886
See application file for complete search history.

(56) References Cited

U.S. PATENT DOCUMENTS

2004/0131391 A1* 7/2004 Nagashiro ..... G03G 15/0877 399/258
2007/0077101 A1* 4/2007 Tamura ..... G03G 15/0875 399/262
2007/0212118 A1 9/2007 Nagae et al.
2009/0232547 A1 9/2009 Nagae et al.

FOREIGN PATENT DOCUMENTS

JP 2006309147 A 11/2006
JP 2013205736 A 10/2013

* cited by examiner

*Primary Examiner* — David Gray
*Assistant Examiner* — Thomas Giampaolo, II
(74) *Attorney, Agent, or Firm* — Alleman Hall McCoy Russell & Tuttle LLP

(57) ABSTRACT

A toner case includes a case main body, a toner discharge outlet, an opening/closing member, a lever member, and a lock member. The case main body can be attached to and detached from an apparatus main body of an image forming apparatus and store toner. The toner discharge outlet is formed on the case main body. The opening/closing member can be moved between an opening position and a closing position. The lever member can be operated between first and second operation positions. The lock member can be moved between: a lock position to abut on the opening/closing member and the lever member, lock the opening/closing member to the closing position and lock the lever member to the first operation position; and an unlock position to be separated from the opening/closing member and the lever member and allow the opening/closing member and the lever member to be released from locks.

15 Claims, 24 Drawing Sheets

TONER CASE AND IMAGE FORMING APPARATUS INCLUDING THE SAME

INCORPORATION BY REFERENCE

This application is based upon and claims the benefit of priority from the corresponding Japanese Patent Application No. 2014-155579 filed on Jul. 30, 2014, and No. 2014-155580 filed on Jul. 30, 2014, the entire contents of which are incorporated herein by reference.

BACKGROUND

The present disclosure relates to a toner case that can open and close a toner discharge outlet through which toner is discharged from a case main body to an apparatus main body of an image forming apparatus, and relates to the image forming apparatus to which the toner case is attached.

A developing device is installed in an image forming apparatus such as a copier, a printer or the like that forms an image on a print sheet by the electrophotography. The toner inside the developing device is decreased as the developing device performs the developing. As a result, the image forming apparatus is configured such that a toner case storing toner can be attached to and detached from the image forming apparatus. The toner is supplied from the toner case to the developing device in the state where the toner case is attached to the image forming apparatus.

The toner case includes a stirring paddle for stirring the toner, a toner discharge outlet for discharging the toner to outside, a screw for conveying the toner to the toner discharge outlet, and an opening/closing member for opening and closing the toner discharge outlet. Conventionally, an operation lever, which is attached to the toner case or the apparatus main body, is operated so as to displace the opening/closing member between the opening position and the closing position, thereby allowing the toner discharge outlet to be opened and closed. In addition, a lock mechanism for locking the operation lever is provided to prevent toner from leaking from the toner discharge outlet when the operation lever is operated erroneously.

On the other hand, there is known an image forming apparatus including; an operation lever that is disposed so as to be pivoted around the rotational axis of the stirring paddle; and a power transmission mechanism that transmits a pivotal force of the lever directly to the opening/closing member, wherein the opening/closing member is opened and closed as the operation lever is pivoted.

SUMMARY

A toner case according to an aspect of the present disclosure includes a case main body, a toner discharge outlet, an opening/closing member, a lever member, and a lock member. The case main body is configured to be attached to and detached from an apparatus main body of an image forming apparatus and store toner. The toner discharge outlet is formed on the case main body. The opening/closing member is configured to open and close the toner discharge outlet and be moved between an opening position and a closing position. The lever member is configured to be operated between a first operation position and a second operation position such that the lever member at the first operation position allows the opening/closing member to be positioned at the closing position, and the lever member at the second operation position allows the opening/closing member to be positioned at the opening position. The lock member is configured to be moved between a lock position and an unlock position such that the lock member at the lock position abuts on both the opening/closing member and the lever member, locks the opening/closing member to the closing position and locks the lever member to the first operation position, and the lock member at the unlock position is separated from both the opening/closing member and the lever member and allows the opening/closing member and the lever member to be released from respective locks. When the case main body is in an attached attitude where the case main body is attached to the apparatus main body, the lock member is positioned at the lock position, and when the case main body is in an unattached attitude where the case main body is not attached to the apparatus main body, the lock member is positioned at the unlock position.

An image forming apparatus according to another aspect of the present disclosure includes an apparatus main body and the toner case configured to be attached to and detached from the apparatus main body. The apparatus main body includes a drive transmission mechanism configured to transmit a driving force that is input by an operation of the lever member, to the opening/closing member when the toner case is attached to the apparatus main body.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
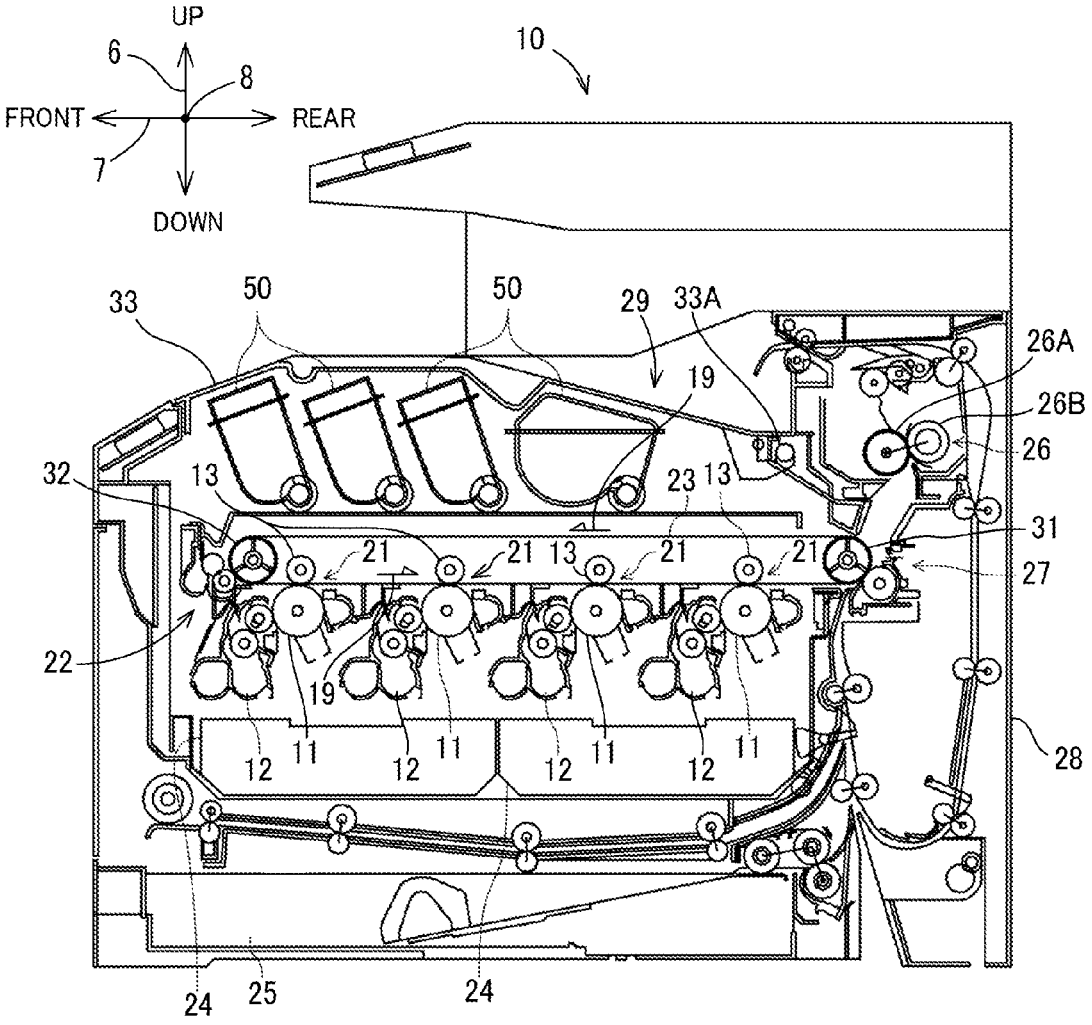
FIG. 1 is a diagram showing the configuration of an image forming apparatus according to an embodiment of the present disclosure.

The following describes an embodiment of the present disclosure with reference to the attached drawings. It should be noted that the following description is an example of a specific embodiment of the present disclosure and should not limit the technical scope of the present disclosure. It is noted that for the sake of explanation, an up-down direction 6 is defined based on the state (the state shown in FIG. 1) where an image forming apparatus 10 in an embodiment of the present disclosure is installed on a flat surface. In addition, a front-rear direction 7 is defined on the supposition that the left side on the plane of FIG. 1 is the front side (front-surface side) of the image forming apparatus 10. Furthermore, a left-right direction 8 (a direction perpendicular to the plane of FIG. 1) is defined based on the image forming apparatus 10 of FIG. 1 viewed from the front side. Accordingly, the front side on the plane of FIG. 1 is the right side, and the depth side on the plane of FIG. 1 is the left side.

[Image Forming Apparatus 10]

The image forming apparatus 10 is an image forming apparatus that includes at least a print function. As shown in FIG. 1, the image forming apparatus 10 is a color printer of a so-called tandem type. The image forming apparatus 10 prints an image on a sheet of print paper by using a developer that contains toner. It is noted that the image forming apparatus 10 may be any apparatus as far as it has the print function. For example, the image forming apparatus 10 may be a multifunction peripheral having a plurality of functions including the print function, or an image forming apparatus such as a FAX apparatus or a copier. Of course, the image forming apparatus 10 may be an apparatus for forming a monochrome image, instead of an apparatus for forming a color image.

As shown in FIG. 1, the image forming apparatus 10 includes, as major components, four image forming portions 21, an intermediate transfer unit 22, a sheet feed device 25, a fixing device 26, a secondary transfer device 27, an exposure device 24, and four toner containers 50 (50A-50D). These components are attached to an apparatus main body 28 that is a housing constituting an external frame (not shown), an internal frame (not shown) and the like of the image forming apparatus 10. It is noted that the toner containers 50 of the image forming apparatus 10 are an example of the toner case.

The four image forming portions 21 are disposed below the intermediate transfer unit 22 in the apparatus main body 28. The image forming portions 21 are aligned along the front-rear direction 7. The image forming portions 21 execute an image forming process to form an image on a print sheet based on the so-called electrophotography. Specifically, the image forming portions 21 print an image on a print sheet based on the image data input from outside via a network communication portion (not shown). Each of the image forming portions 21 includes a photoconductor drum 11, a charging device (not shown), a developing device 12, a primary transfer device 13, and the like. The image forming portions 21 form toner images respectively on the photoconductor drums 11, and transfer the toner images to a transfer belt 23 provided in the intermediate transfer unit 22 by overlaying the toner images onto the belt in sequence. The transfer belt 23 moves in a direction of the arrow 19, and the toner images are transferred in sequence to the transfer belt 23 while it is moving. In the example shown in FIG. 1, in order from the downstream side in the movement direction of the transfer belt 23 (the direction of the arrow 19), the image forming portions 21 for black, cyan, magenta and yellow are disposed in a row in the apparatus main body 28.

The intermediate transfer unit 22 is disposed above the image forming portions 21. At opposite ends of the intermediate transfer unit 22 in the front-rear direction 7, a driving pulley 31 and a driven pulley 32 are provided. The transfer belt 23 is supported by the driving pulley 31 and the driven pulley 32 by being suspended therebetween.

The secondary transfer device 27 transfers, from the transfer belt 23 to a print sheet, a color toner image composed of the toner images of the plurality of colors. The print sheet with the color toner image transferred thereon is conveyed to the fixing device 26. In the fixing device 26, the print sheet is passed through a nip portion between the heating roller 26A and the pressure roller 26B while being nipped by a predetermined biasing force. This allows the color toner image to be fused and adhered to the print sheet. Subsequently, the print sheet is discharged onto a sheet discharge tray 29 provided on an upper part of the apparatus main body 28.

The four toner containers 50 (50A-50D) are disposed above the intermediate transfer unit 22. Inside the apparatus main body 28, the four toner containers 50 are aligned in a row along the transfer belt 23 in the front-rear direction 7. The toner containers 50 are configured to supply toner to the developing devices 12 of corresponding colors.

Figure 2:
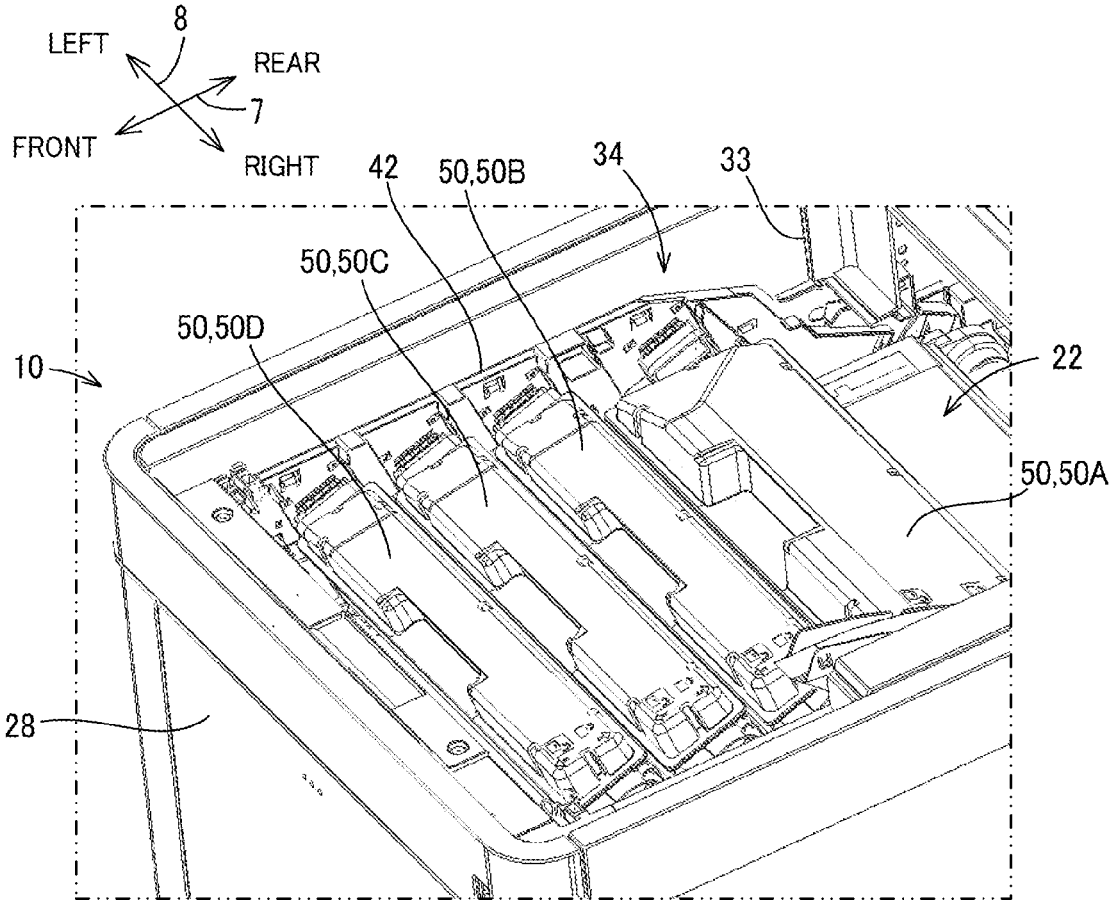
FIG. 2 is a perspective view showing a state where a toner container is attached to an intermediate transfer unit of the image forming apparatus.

As shown in FIG. 2, an attachment portion 34 to which the plurality of toner containers 50 are attached is provided in the apparatus main body 28. Specifically, the attachment portion 34 is provided above the intermediate transfer unit 22. A top cover 33 provided on the upper part of the apparatus main body 28 is supported so as to be opened and closed around a spindle 33A of the apparatus main body 28 (see FIG. 1). When the top cover 33 is pivoted upward (in the opening direction), the attachment portion 34, to which the toner containers 50 are attached, is exposed. The attachment portion 34 is integrally formed with the upper part of the intermediate transfer unit 22, and the toner containers 50 are attached to and stored in the attachment portion 34. It is noted that the attachment portion 34 is not limited to be integrally formed with the upper part of the intermediate transfer unit 22, but may be attached to the apparatus main body 28 as a member independent of the intermediate transfer unit 22.

The toner containers 50 store toner of different colors that correspond to the colors of the image forming portions 21. Specifically, the toner containers 50 (50A-50D) store toner of black, cyan, magenta, and yellow, respectively. As shown in FIG. 1 and FIG. 2, among the four toner containers 50, the toner container 50A positioned on the most rear side is a large-capacity type and can store a larger amount of toner than the other toner containers 50B-50D. The toner container 50A stores black toner. The toner containers 50B-50D have the same shape and capacity. The toner container 50B stores cyan toner, the toner container 50C stores magenta toner, and the toner container 50D stores yellow toner.

[Configuration of Toner Containers 50]

The following describes the configuration of the toner containers 50. It is noted here that the large-capacity-type toner container 50A and the other toner containers 50B-50D have the same configuration except for the size of the toner storing part. In addition, the toner containers 50B-50D have the same configuration except for the arrangement position. As a result, in the following description, the toner containers 50A-50D are described as a toner container 50.

Figure 4:
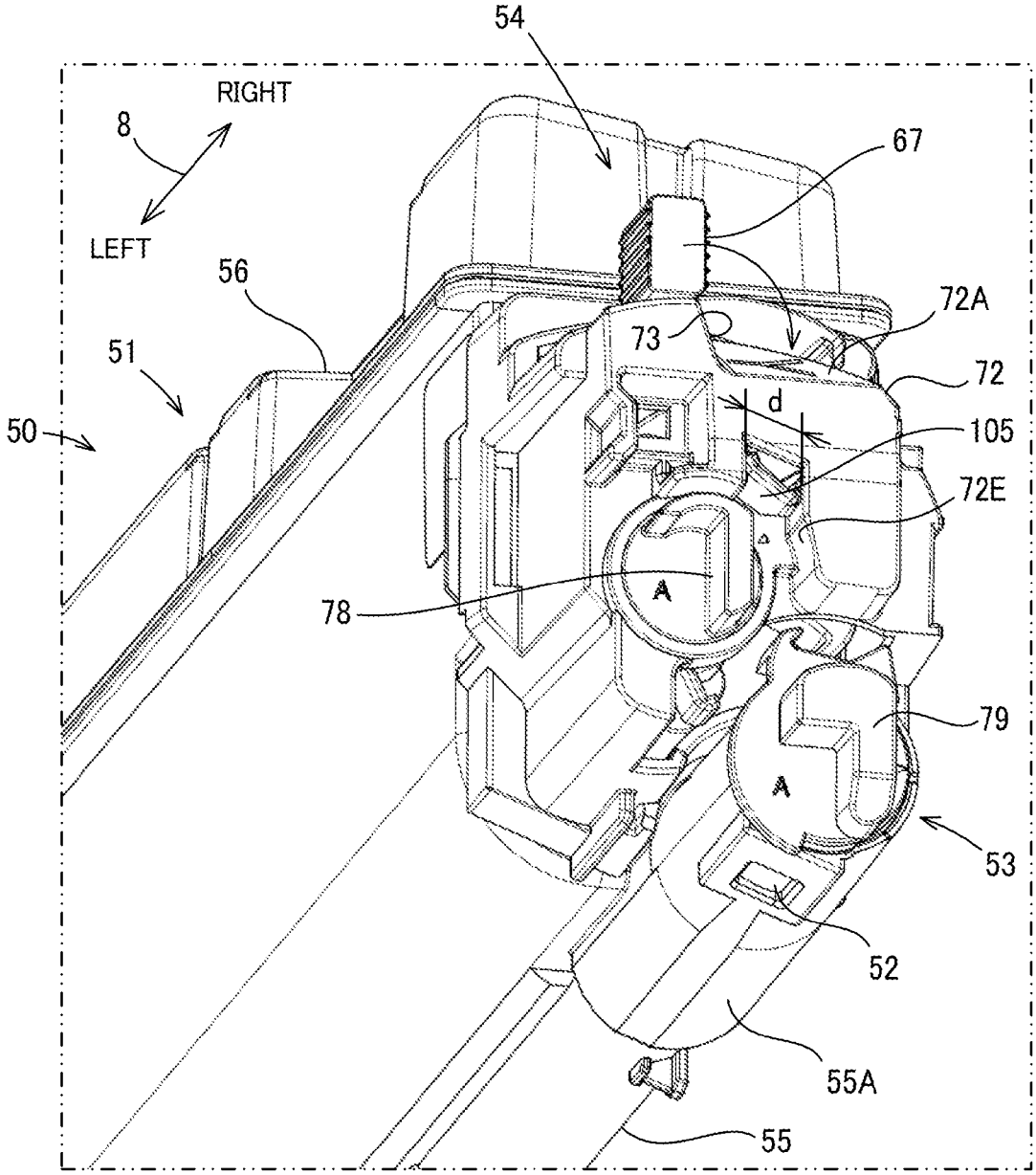
FIG. 4 is a side view showing the configuration of the right side portion of the toner container.
Figure 5:
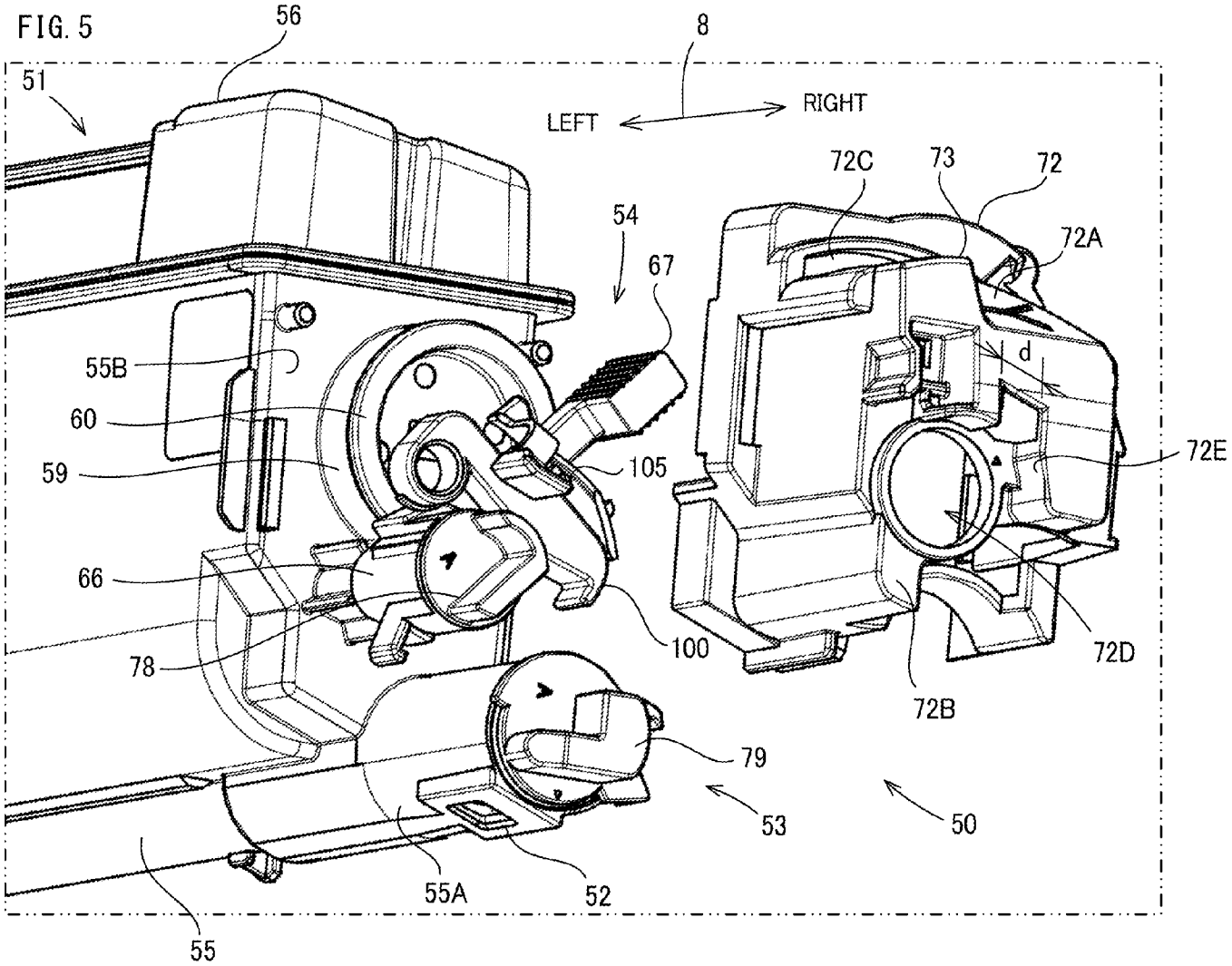
FIG. 5 is a side view showing the configuration of the right side portion of the toner container.
Figure 6:
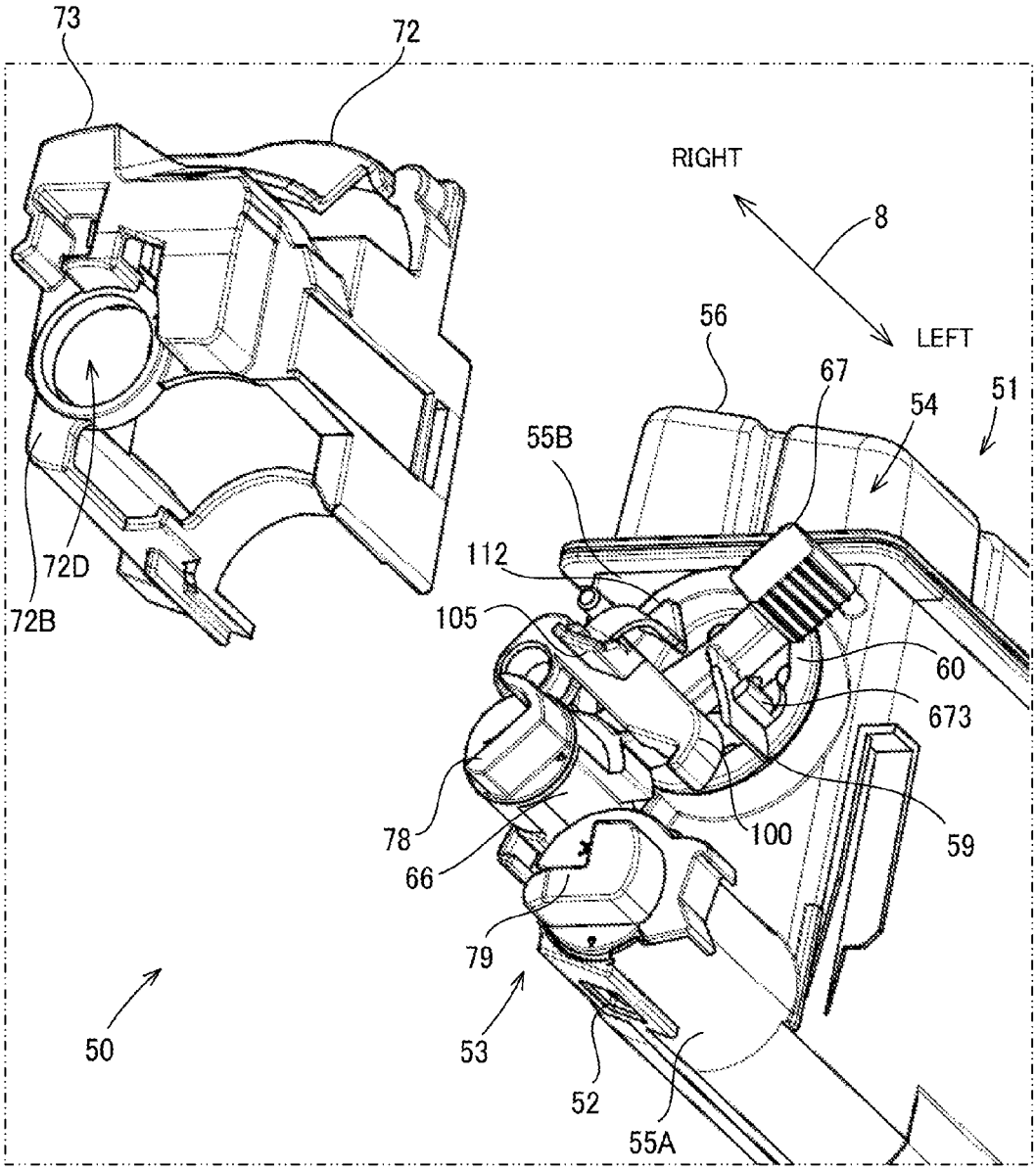
FIG. 6 is a side view showing the configuration of the right side portion of the toner container viewed from a different direction from FIG. 5.

The toner container 50 stores toner that is to be supplied to the developing device 12. As shown in FIG. 3 to FIG. 6, the toner container 50 includes a housing 51, a toner discharge outlet 52 (see FIG. 4), an opening/closing mechanism 53 (see FIG. 4), an operation portion 54, and a cover 72. These components are provided in the peripheral of a side of the toner container 50. The opening/closing mechanism 53 is an example of the opening/closing member of the present disclosure. The housing 51 is attached to the attachment portion 34 of the image forming apparatus 10. Toner is stored in the housing 51. As shown in FIG. 4, the toner discharge outlet 52 is formed on the housing 51. The toner discharge outlet 52 is formed in the bottom of the housing 51 at the right end thereof. In addition, as shown in FIG. 5 and FIG. 6, the operation portion 54 is provided on the housing 51 so as to be operated by the user.

Figure 3:
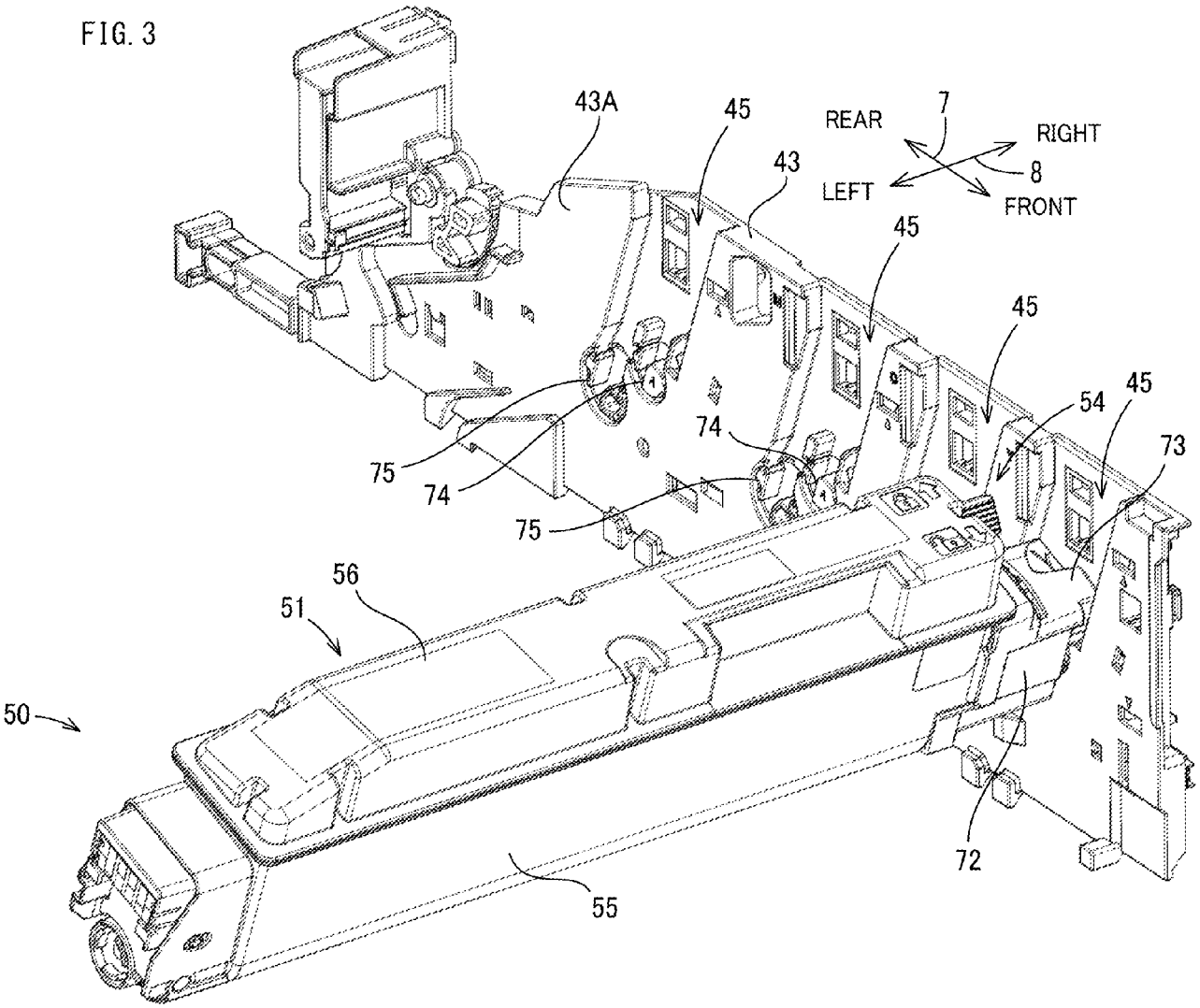
FIG. 3 is a perspective view showing the toner container and an attachment portion thereof.

As shown in FIG. 2 and FIG. 3, the apparatus main body 28 includes support plates 42 and 43 to which the housing 51 is attached. The support plates 42 and 43 are each formed plate-like and extend in the front-rear direction 7. The support plates 42 and 43 are disposed to face each other in the attachment portion 34. As shown in FIG. 2, the support plate 42 is erected at the left end of the attachment portion 34. As shown in FIG. 3, the support plate 43 is erected at the right end of the attachment portion 34. The support plates 42 and 43 support opposite ends of the four toner containers 50 respectively.

On a left side surface 43A (see FIG. 3) of one side (the left side) of the support plate 43, a plurality of groove-like container guides 45 are formed to extend diagonally upward. The container guides 45 are formed groove-like by recessing the left side surface 43A of the support plate 43 in the thickness direction. In addition, each container guide 45 is formed such that an end portion thereof on the upper side of the support plate 43 is formed to spread upward. The right end portion of the housing 51 is attached to the support plate 43 by being guided by the container guide 45 diagonally downward from the upper end of the support plate 43.

The housing 51 is made of a resin material, and is, as shown in FIG. 3, formed in the shape of a box that is long in the left-right direction 8. That is, the longitudinal direction of the housing 51 matches the left-right direction 8 of the image forming apparatus 10 shown in FIG. 1.

As shown in FIG. 3, the housing 51 includes a container main body 55 and a lid portion 56. The container main body 55 is formed in the shape of a box which has a bottom and whose upper part is opened. The container main body 55 is an example of the case main body of the present disclosure. The lid portion 56 closes the upper opening portion of the container main body 55. Inside the container main body 55, a stirring member 800 (see FIG. 9) having a paddle-like blade and a conveyance member 58 (see FIG. 9) having a screw-like blade are provided, wherein the stirring member 800 is configured to stir the toner, and the conveyance member 58 is configured to convey the toner to the toner discharge outlet 52.

As shown in FIG. 5, the cover 72 is provided in such a way as to cover a right side wall 55B of the container main body 55. The side wall 55B is provided with a toner filling port 59 that allows the toner to be filled into the housing 51. The toner filling port 59 is closed by a plug member 60.

Figure 9:
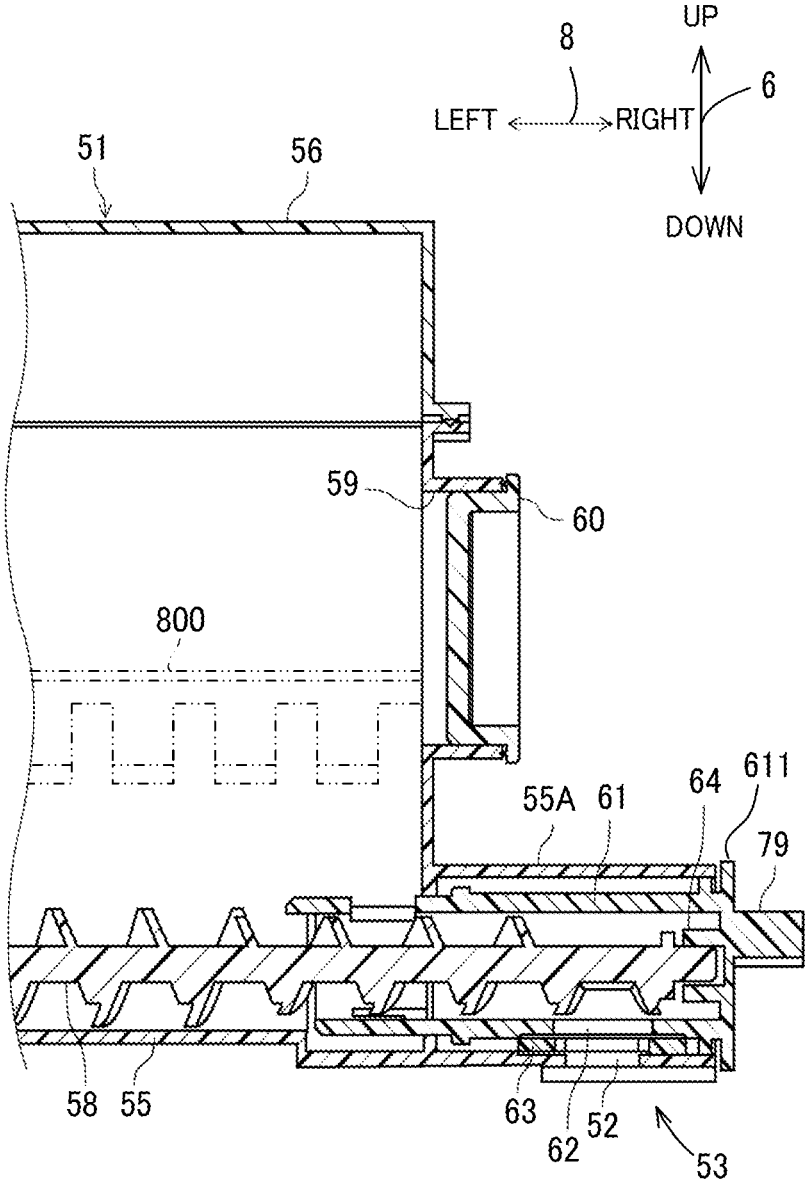
FIG. 9 is a cross sectional view showing a cross-sectional configuration of the right side portion of the toner container.

As shown in FIG. 4-FIG. 6 and FIG. 9, the toner discharge outlet 52 is formed in the toner container 50. Specifically, the toner discharge outlet 52 is formed in the bottom of the container main body 55 at the right end thereof. The toner discharge outlet 52 is formed in such a way as to pass through the bottom wall of the container main body 55 downward. Specifically, as shown in FIG. 9, a protruding portion 55A is formed at the right end of the container main body 55, wherein the protruding portion 55A is in an approximate shape of a cylinder protruding and extending rightward. The toner discharge outlet 52 is formed in such a way as to pass through the circumferential wall of the protruding portion 55A downward.

The opening/closing mechanism 53 opens and closes the toner discharge outlet 52, and as shown in FIG. 9, includes a cylinder 61, an opening 62, a seal member 63, and a second coupling portion 79. The cylinder 61 is formed in the shape of a cylinder and inserted in the protruding portion 55A that is provided at the right end of the container main body 55. The right end portion of the cylinder 61 is closed by an end surface portion 611. In addition, the right end portion of the cylinder 61 is integrally formed with the second coupling portion 79 that is described below. The opening 62 is formed in a circumferential surface of the cylinder 61. Furthermore, the seal member 63 is provided on an inner wall surface of the protruding portion 55A at the peripheral of the toner discharge outlet 52. The seal member 63 is provided for prevention of scattering of toner.

The cylinder 61 is supported inside the protruding portion 55A such that it can pivot along the inner circumferential surface of the protruding portion 55A. This allows the cylinder 61 to rotate around a rotational axis center P1 that matches the center line of the protruding portion 55A. A bearing 64 is formed inside the end surface portion 611 of the cylinder 61. One end of the conveyance member 58 is rotationally supported by the bearing 64 for the conveyance member 58 to rotate in the cylinder 61. Therefore, the rotational axis of the conveyance member 58 matches the rotational axis center P1 of the cylinder 61. It is noted that the rotational axis center P1 is an example of the first pivotal axis of the present disclosure.

The cylinder 61 is rotatably attached to the protruding portion 55A. When a rotational force is input to the second coupling portion 79, the cylinder 61 is rotated. When the cylinder 61 rotates and the opening 62 of the cylinder 61 overlaps with the toner discharge outlet 52, the toner discharge outlet 52 is opened as shown in FIG. 9. Hereinafter, the position of the cylinder 61 (the position shown in FIG. 9) that allows the toner discharge outlet 52 to be opened is referred to as an "opening position". When the cylinder 61 is rotated to the opening position, toner in the housing 51 is discharged from the toner discharge outlet 52 to outside smoothly. On the other hand, when the cylinder 61 rotates and the circumferential wall of the cylinder 61 except for the opening 62 overlaps with the toner discharge outlet 52, the toner discharge outlet 52 is closed by the circumferential wall of the cylinder 61. Hereinafter, the position of the cylinder 61 where the toner discharge outlet 52 is closed is referred to as a "closing position". When the cylinder 61 is rotated to the closing position, the toner discharge outlet 52 is completely closed.

With the rotation of the second coupling portion 79, the cylinder 61 is displaced between the opening position and the closing position. That is, the toner discharge outlet 52 is opened and closed with the rotation of the cylinder 61. When the toner container 50 is attached to the attachment portion 34, the second coupling portion 79 is coupled with a drive transmission mechanism 76 (see FIGS. 20A, 20B and 21) that is provided in the apparatus main body 28 (specifically, in the attachment portion 34). This allows the second coupling portion 79 to receive the rotational force from the drive transmission mechanism 76. It is noted that the drive transmission mechanism 76 and the second coupling portion 79 are described in detail below.

When the toner container 50 is attached to the attachment portion 34, the toner discharge outlet 52 is disposed in front of a communication port (not shown) that is formed in the intermediate transfer unit 22, and closely contacts with the communication port. The toner is supplied from the communication port to the developing device 12 via a conveyance path (not shown). The attachment position of the toner container 50 in the attachment portion 34 is determined so that the above-described positional relationship is satisfied. The operation portion 54 is used to open and close the toner discharge outlet 52 in the state where the toner container 50 is attached to the attachment portion 34. As shown in FIG. 5 and FIG. 6, the operation portion 54 is provided at the right end of the container main body 55. The operation portion 54 includes a shaft 66 and a lever 67 (an example of the lever member). The shaft 66 is rotatably supported by the container main body 55. The lever 67 extends from the shaft 66. The operation portion 54 is made of a synthetic resin.

Figure 7A:
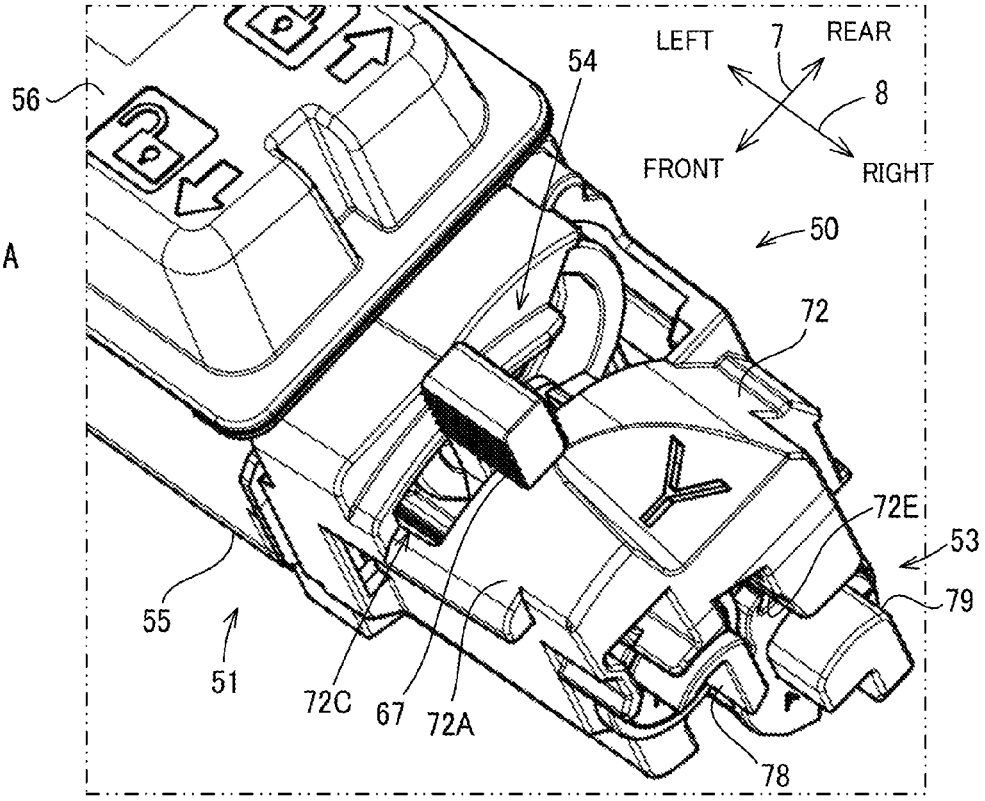
FIG. 7A and FIG. 7B are perspective views showing the configuration of the right side portion of the toner container in the state where the lever of the operation portion is pivoted.
Figure 7B:
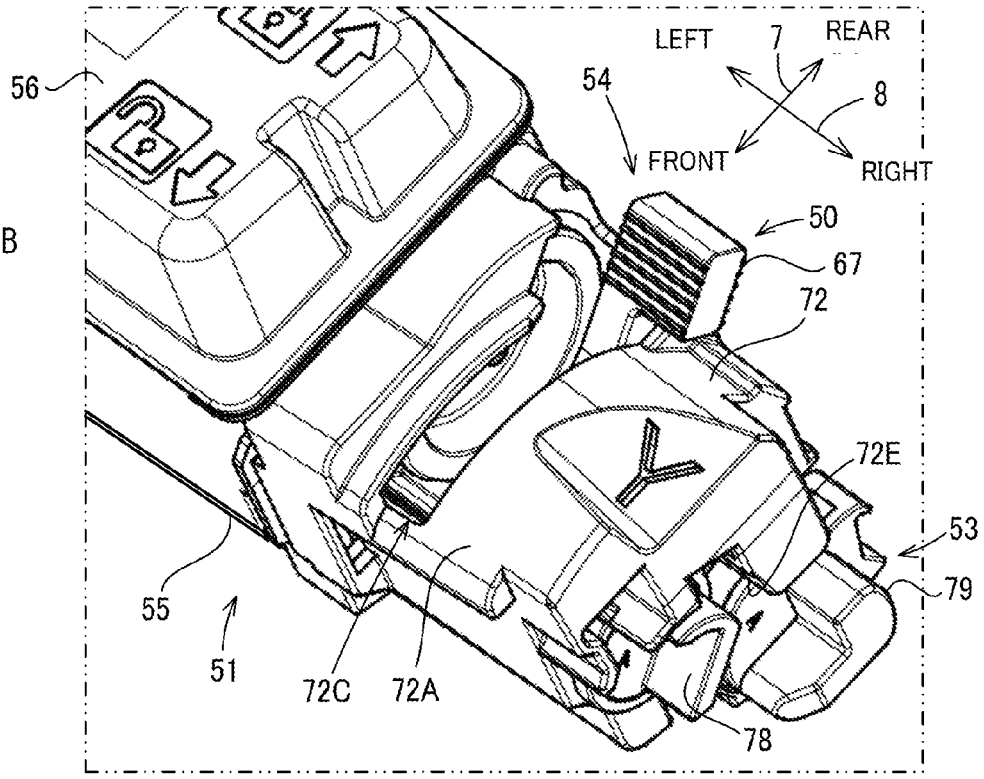

The housing 51 includes a cylindrical boss (not shown) that projects rightward from the right end of the housing 51. The shaft 66 is rotatably supported by the boss. This enables the shaft 66 to rotate around the center line (hereinafter referred to as a pivotal axis center P3; see FIG. 10) of the boss. As a result, the lever 67 can integrally rotate with the shaft 66 around the pivotal axis center P3. In the present embodiment, the operation portion 54 can pivot between a first operation position (the attitude shown in FIG. 7A and FIG. 17A) and a second operation position (the attitude shown in FIG. 7B and FIG. 17C), wherein the lever 67 is erected to extend upward vertically in the first operation position, and is inclined rearward in the second operation position. In the present embodiment, with the operation of the lever 67 between the first operation position and the second operation position, the cylinder 61 of the opening/closing mechanism 53 is moved to the closing position corresponding to the first operation position, or to the opening position corresponding to the second operation position. Here, the first operation position is an attitude corresponding to the closing position of the cylinder 61, and the second operation position is an attitude corresponding to the opening position of the cylinder 61.

In the present embodiment, in addition to the first operation position and the second operation position, a third operation position (see FIG. 17D, FIG. 18D) is provided as an operation position of the lever 67. The third operation position is a position that can be reached by pivoting the fixing portion 6 by a predetermined angle from the first operation position in an opposite direction to the second operation position. The third operation position is a shipping-only position in the image reading device 1 or the developer conveying portion 50. That is, for the shipment of the image reading device 1 or the developer conveying portion 50, the operation portion 54 is set such that the lever 67 is positioned at the third operation position. Once the lever 67 is pivoted from the third operation position to the first operation position or the second operation position, the lever 67 cannot be returned to the third operation position. It is noted that when the lever 67 is positioned at the third operation position, the cylinder 61 is positioned at the closing position. The configuration where once the lever 67 is pivoted from the third operation position, the lever 67 cannot be returned to the third operation position is described below.

As shown in FIG. 4 to FIG. 6, the cover 72 is attached to the side wall 55B at the right end of the container main body 55. The cover 72 is attached in such a way as to cover the base part of the lever 67, a lock member 100 and the like. On an arc-shaped upper wall 72A of the cover 72, a slit 72C is formed to extend along the operation direction of the lever 67. An upper end of the lever 67 extends out upward from the slit 72C to be exposed to outside. A right side wall 72B of the cover 72 has an opening 72D, and a first coupling portion 78 described below extends out rightward from the opening 72D to be exposed to outside. In addition, on the right side surface 72B, a guide groove 72E is formed, wherein the guide groove 72E extends vertically and is opened downward. As shown in FIG. 4, a pressed portion 105 of the lock member 100 is exposed from the cover 72 at the guide groove 72E. It is noted that the second coupling portion 79 of the cylinder 61 is not covered with the cover 72 since the second coupling portion 79 is connected to the second rotation portion 75 of the drive transmission mechanism 76. Here, when the user holds the developer conveying portion 50 by grasping the side portion of the developer conveying portion 50, a finger of the user might touch the pressed portion 105 of the lock member 100. When a finger of the user touches and pushes the pressed portion 105 upward, the toner discharge outlet 52 might be opened and toner might leak therefrom.

Figure 19:
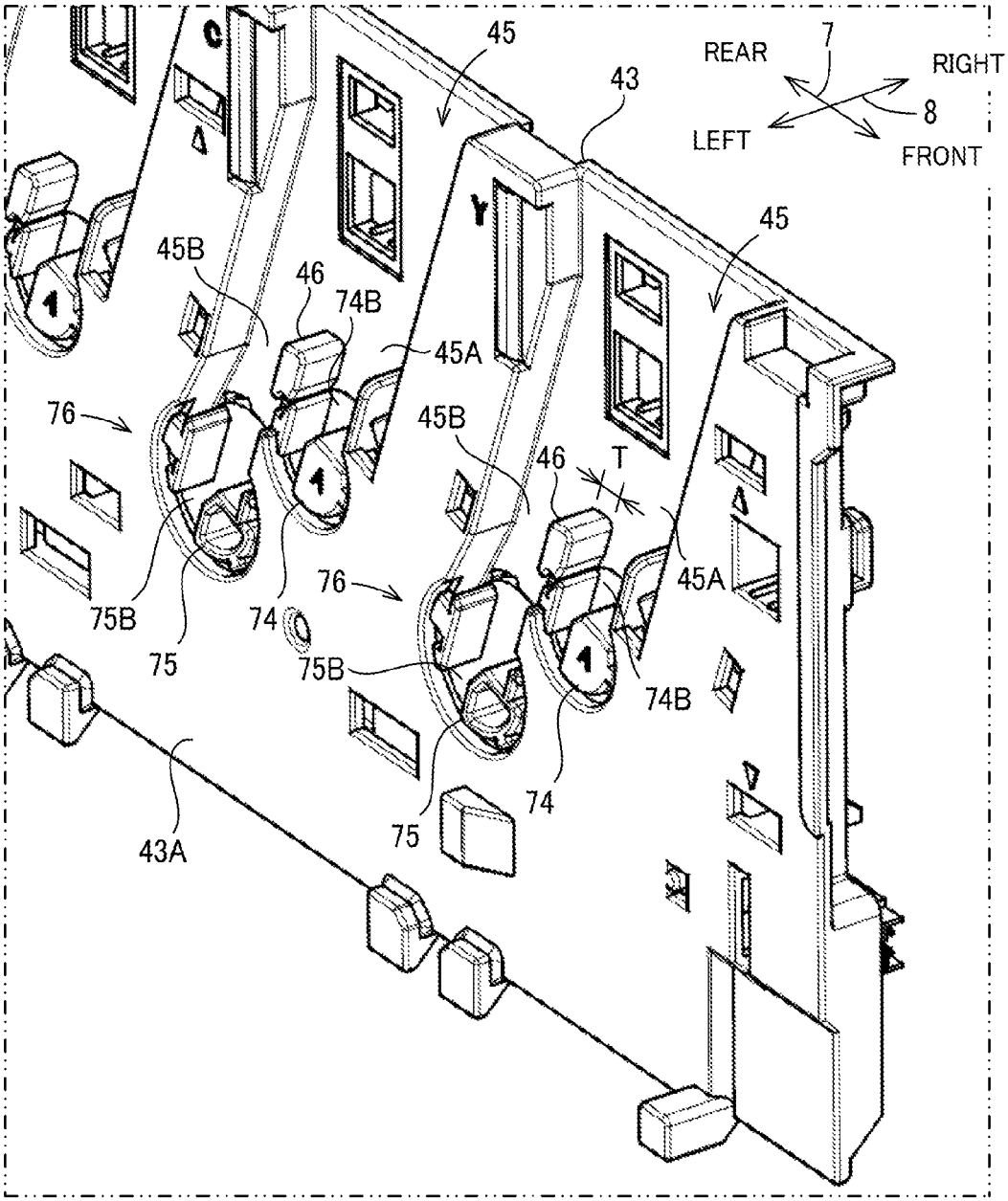
FIG. 19 is a diagram partially showing the configuration of a support plate of the attachment portion.

In view of the above-mentioned problem, in the present embodiment, a projection portion 46 (an example of the pressing piece of the present disclosure; see FIG. 19) having a shape of a plate with a narrow width is formed on the support plate 43. In addition, the guide groove 72E has a width d (see FIG. 4) that is set so that the projection portion 46 can be inserted in the guide groove 72E. Specifically, the width d of the guide groove 72E is set in an extent that a finger of a general user cannot be inserted in the guide groove 72E, or if a finger is inserted a little, it does not touch the pressed portion 105 of the lock member 100. The guide groove 72E is an example of the insertion hole of the present disclosure.

The cover 72 includes a block-like positioning projection 73 projecting rightward from the right end of the container main body 55. The positioning projection 73 is formed with a width that is slightly smaller than the groove width of the container guide 45 such that the positioning projection 73 can be fitted in the container guide 45 (see FIG. 3). This enables the positioning projection 73 to be attached to the container guide 45. Specifically, as shown in FIG. 3, when the positioning projection 73 is fitted in the container guide 45 and guided by the container guide 45 diagonally downward, the housing 51 is attached to the support plate 43.

Meanwhile, conventionally, when the operation portion 54 is locked, both the lever 67 and the opening/closing mechanism 53 are locked if either the lever 67 or the opening/closing mechanism 53 is locked. However, in the case where there is no power transmission mechanism for transmitting the pivotal force of the lever 67 directly to the opening/closing mechanism 53, both the lever 67 and the opening/closing mechanism 53 need to be locked. In the present embodiment, the lock member 100, which is described below, is provided such that both the lever 67 and the opening/closing mechanism 53 can be locked in a reliable manner.

The lock member 100 is provided at the right end of the container main body 55. The lock member 100 is made of a synthetic resin and configured to lock the operation portion 54 and the opening/closing mechanism 53 for the purpose of preventing them from malfunctioning. The following explains this in detail.

Figure 10:
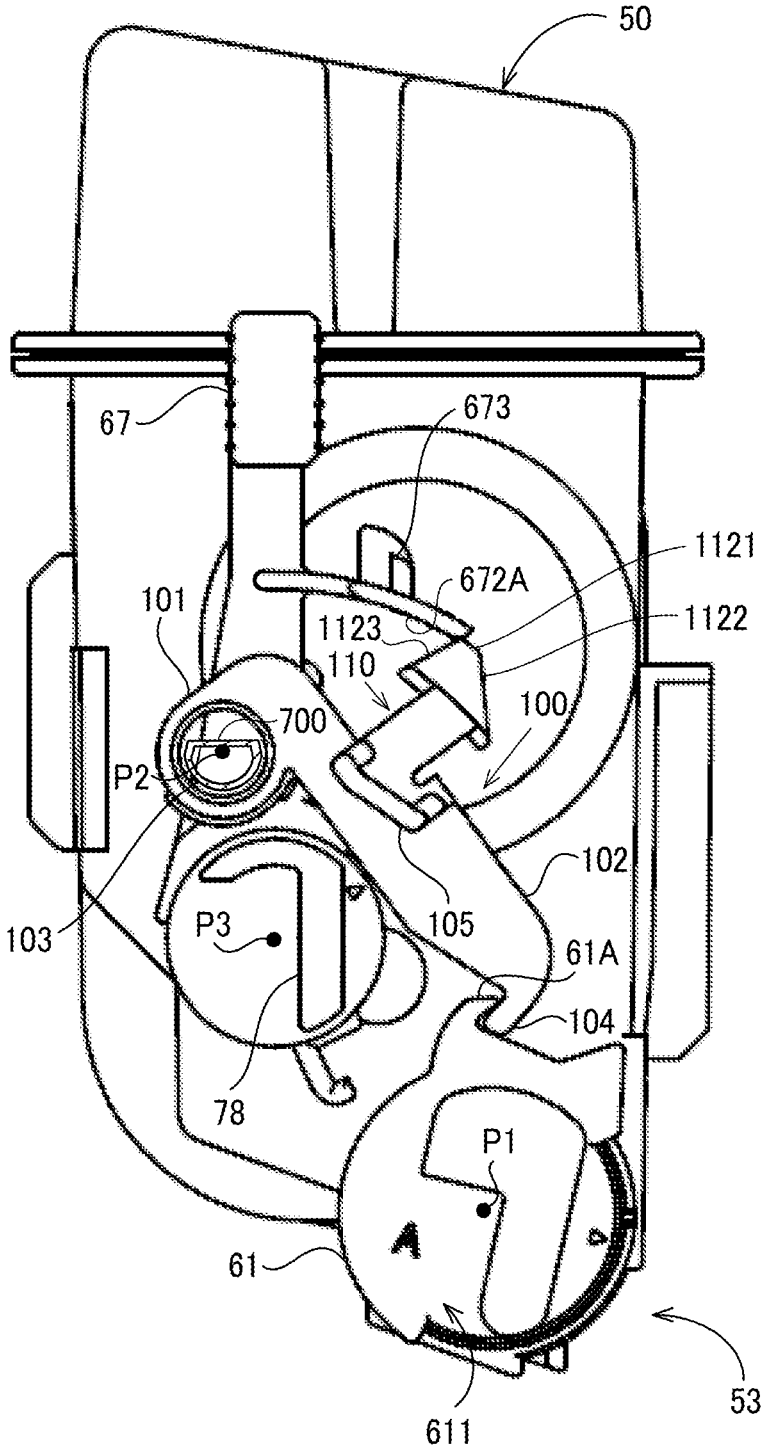
FIG. 10 is a side view showing the configuration of the right side portion of the toner container in the state where the cover is removed.
Figure 12A:
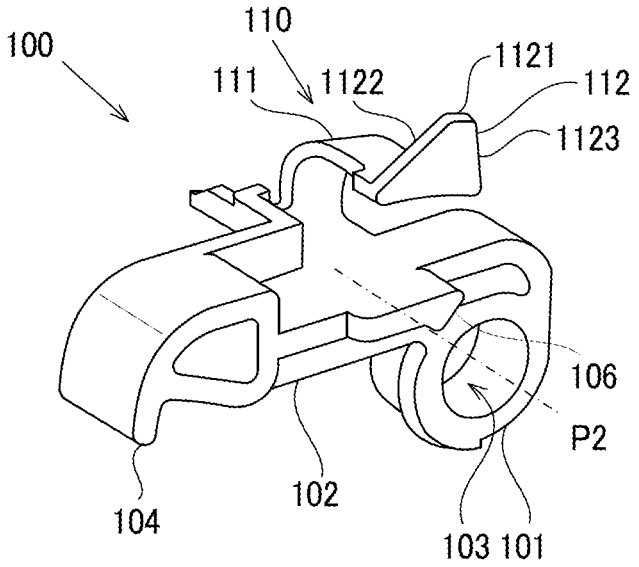
FIGS. 12A and 12B are perspective views of a single lock member.
Figure 12B:
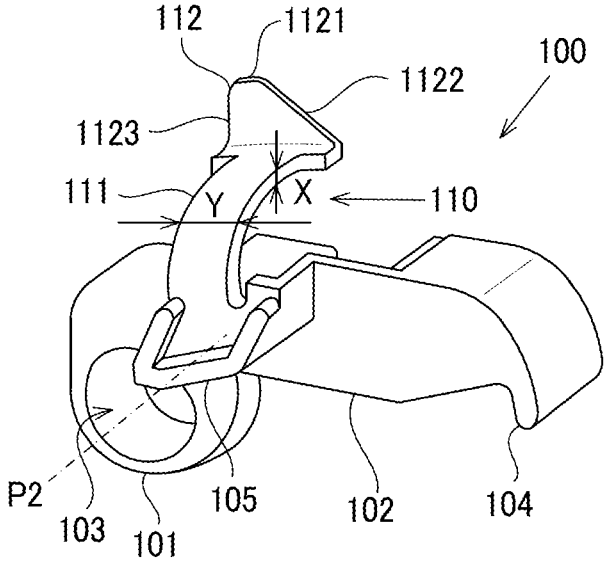

As shown in FIG. 5 and FIG. 6, the lock member 100 is covered with the cover 72. Inside the cover 72, a pivoting supporting portion 700 is provided above the opening 72D (see FIG. 10), wherein the pivoting supporting portion 700 is cylindrical and provided around a pivotal axis center P2 that is parallel to the pivotal axis center P3 of the stirring member 800 (see FIG. 10). It is noted that in FIG. 10, the cover 72 is omitted and only the pivoting supporting portion 700 provided on the cover 72 is indicated in a cross section (hatched part). The pivotal axis center P2 is an example of the second pivotal axis of the present disclosure, and the pivotal axis center P3 is an example of the third pivotal axis of the present disclosure. As shown in FIGS. 12A and 12B, the lock member 100 includes a base portion 101 and an arm portion 102. The base portion 101 has a shaft hole 103 whose diameter is approximately the same as the diameter of the pivoting supporting portion 700. The shaft hole 103 of the base portion 101 is fitted on the pivoting supporting portion 700 in the state where a predetermined slip-off prevention has been made, and the base portion 101 is pivotably supported by the pivoting supporting portion 700. As shown in FIG. 10, when the toner container 50 is in an attached attitude where the toner container 50 is attached to the apparatus main body 28, the lock member 100 is positioned above the opening/closing mechanism 53. In addition, the pivotal axis center P2 is positioned above the pivotal axis center P3. The arm portion 102 extends from the base portion 101 in a direction perpendicular to the pivotal axis center P2 of the pivoting supporting portion 700, and a first engaging portion 104 is formed on the tip of the arm portion 102. The first engaging portion 104 projects from the main body of the arm portion 102 toward the opening/closing mechanism 53 at approximately right angle like a claw.

A first engaged portion 61A is provided on the end surface portion 611 of the cylinder 61 of the opening/closing mechanism 53. Specifically, the first engaged portion 61A projects like a claw from a predetermined position on the circumference of the end surface portion 611, on a plane parallel to the end surface portion 611. The first engaged portion 61A is at an upper position when the lever 67 is at the first operation position. At this time, the first engaged portion 61A projects diagonally upward from the main body of the end surface portion 611, and is engaged with the first engaging portion 104. This allows the cylinder 61 to be restricted from pivoting, and locks the opening/closing mechanism 53 to the closing position.

The lock member 100 includes the pressed portion 105. The pressed portion 105 is pressed upward from the opening at an end of the guide groove 72E by the projection portion 46 of the support plate 43 that is guided into the guide groove 72E during the process where the toner container 50 is attached to the apparatus main body 28. When the pressed portion 105 receives the upward force from the projection portion 46, the force becomes the pivotal force for the lock member 100 to pivot around the pivotal axis center P2 in the state where the lock member 100 is axially supported by the pivoting supporting portion 700. At this time, the first engaging portion 104 moves away from the first engaged portion 61A, and the lock of the opening/closing mechanism 53 is released (see FIG. 17A, FIG. 17B).

Figure 11A:
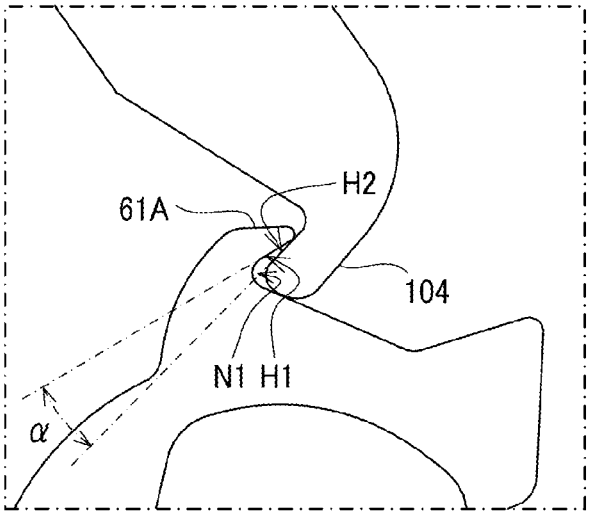
FIGS. 11A-11C are diagrams for explaining a lock mechanism between a lock member and an opening/closing mechanism.

As shown in FIG. 11A, an engaged surface H1, of the first engaged portion 61A, that is engaged with the first engaging portion 104, and an engaging surface H2, of the first engaging portion 104, that is engaged with the first engaged portion 61A, are planes. Here, when the first engaged portion 61A is engaged with the first engaging portion 104, a tip of the first engaged portion 61A in the projection direction makes a point contact with the engaging surface H2. In this state, a predetermined angle $\alpha$ is formed between the engaged surface H1 and the engaging surface H2, and the tip of the first engaged portion 61A is engaged with the engaging surface H2 of the first engaging portion 104.

Figure 11B:
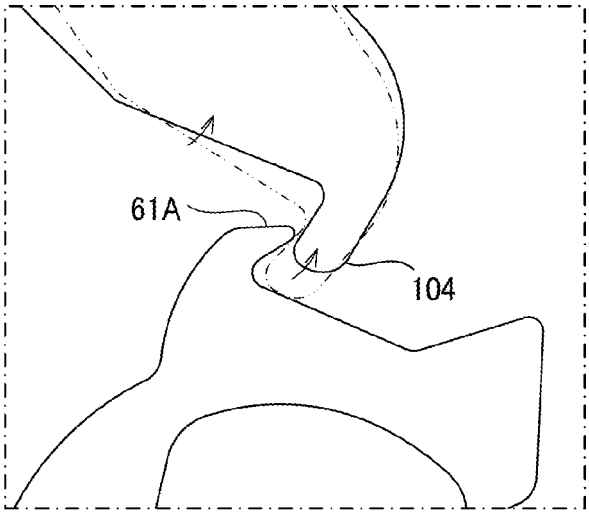

In the state where the first engaged portion 61A and the first engaging portion 104 are engaged with each other (hereinafter, the state is referred to as an engaged state), when the upward force is received from the projection portion 46, the lock member 100 pivots around the pivotal axis center P2, the first engaging portion 104 moves away from the first engaged portion 61A without being caught thereby (see FIG. 11B), and the lock of the opening/closing mechanism 53 is released.

Figure 11C:
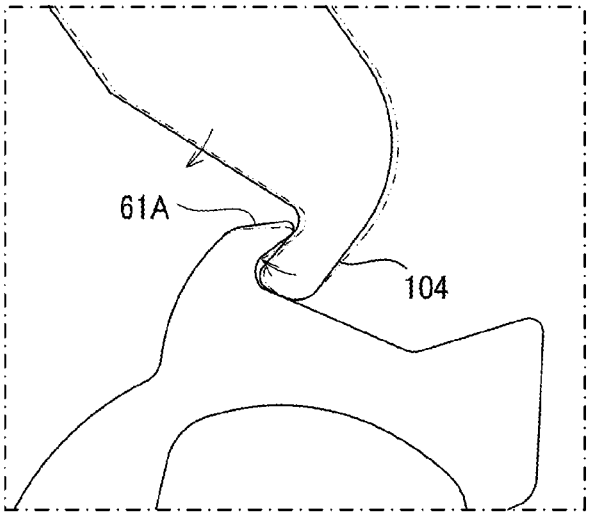

On the other hand, when the toner container 50 is in an unattached attitude where the toner container 50 is not attached to the apparatus main body 28, the lock member 100 may receive an external force in a direction where the first engaging portion 104 moves away from the first engaged portion 61A such that the engaged state is released. In this case, too, since the angle $\alpha$ has been formed between the engaged surface H1 and the engaging surface H2, the first engaging portion 104 is fitted in a recessed portion N1 formed in the first engaged portion 61A with a slight deformation of the first engaged portion 61A and the first engaging portion 104 (see FIG. 11C). At this time, the first engaged portion 61A and the first engaging portion 104 are engaged with each other more securely.

Figure 13A:
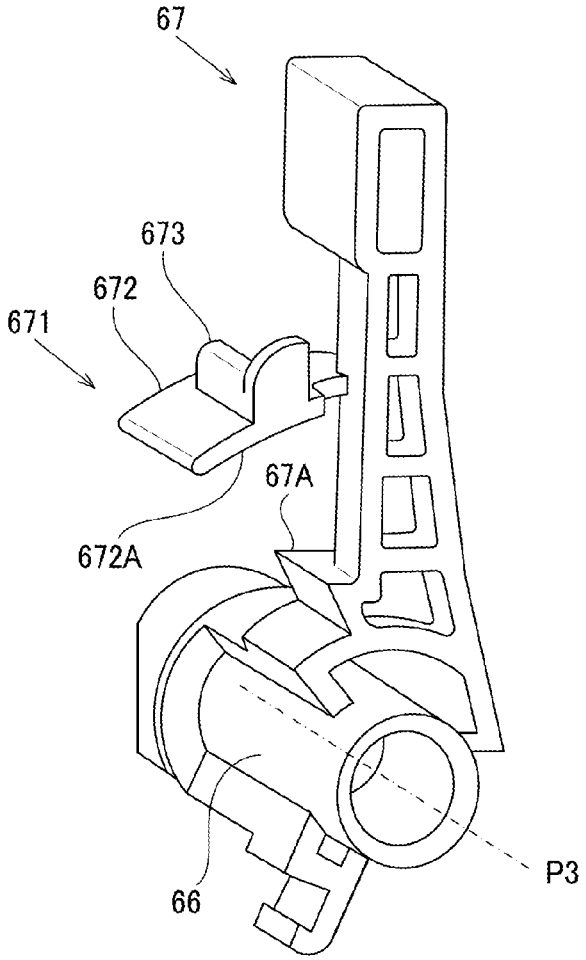
FIGS. 13A and 13B are perspective views of a single lever member.
Figure 13B:
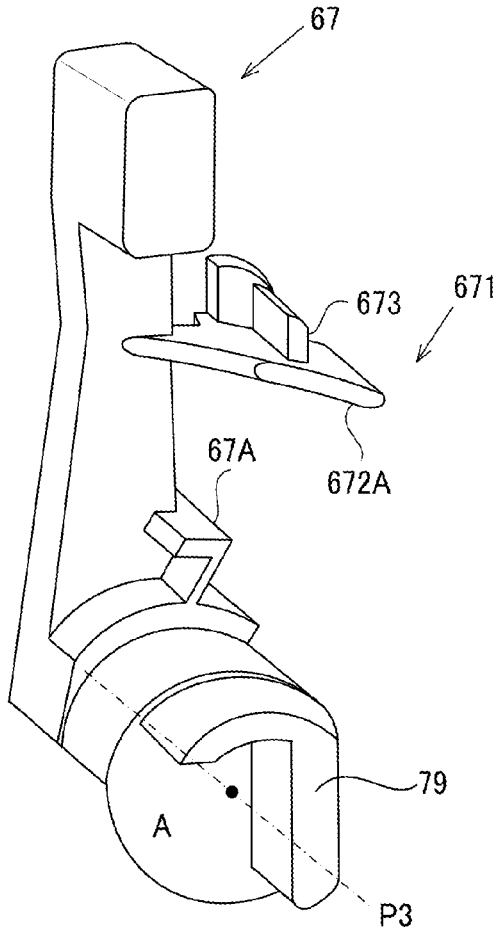

As shown in FIG. 13A and FIG. 13B, the lever 67 includes a second engaged portion 67A. The second engaged portion 67A is provided at a predetermined position on the side of the base end of the lever 67, namely, close to the pivotal axis center P3 of the lever 67. As shown in FIG. 12A, the lock member 100 includes a second engaging portion 106. The second engaging portion 106 is formed at approximately the center of the arm portion 102 in the longitudinal direction thereof, on a portion opposite to the pressed portion 105. The second engaged portion 67A and the second engaging portion 106 are configured to be engaged with each other (see FIG. 18A). When the first engaged portion 61A and the first engaging portion 104 are engaged with each other and the opening/closing mechanism 53 is locked to the closing position, the second engaged portion 67A and the second engaging portion 106 are engaged with each other. This restricts the lever 67 from moving from the first operation position to the second operation position. Hereinafter, the position of the lock member 100 at this time, namely, the position where the second engaging portion 106 is engaged with the second engaged portion 67A, and the first engaged portion 61A is engaged with the first engaging portion 104, is referred to as a lock position.

In addition, when the lock member 100 is pivoted by the upward force that the pressed portion 105 receives from the projection portion 46, the second engaging portion 106 moves away from the second engaged portion 67A. This allows the restriction (lock) on the movement of the lever 67 to the second operation position to be released. Hereinafter, the position where the restriction on the movement of the lever 67 to the second operation position is released, namely, the position where the second engaging portion 106 is not engaged with the second engaged portion 67A, and the first engaged portion 61A is not engaged with the first engaging portion 104, is referred to as an unlock position. It is noted that the unlock position is a position in a predetermined range in which the lock member 100 is away from the lock position and the restriction on the movement of the lever 67 to the second operation position is released.

As described above, the lock member 100 positioned at the lock position is engaged with the opening/closing mechanism 53 and the lever 67, locks the opening/closing mechanism 53 to the closing position, and locks the lever 67 to the first operation position. On the other hand, the lock member 100 positioned at the unlock position is away from the opening/closing mechanism 53 and the lever 67, allows the opening/closing mechanism 53 to pivot to the opening position, and allows the lever 67 to pivot to the second operation position.

The second engaging portion 106 and the second engaged portion 67A are engaged with each other at a position closer to the pivoting supporting portion 700 than the engagement position of the first engaging portion 104 and the first engaged portion 61A. This makes it possible to prevent the second engaging portion 106 and the second engaged portion 67A in engagement from being damaged when the lever 67 is pivotally operated in the state where the toner container 50 is not attached to the attachment portion 34.

That is, when an operation force is applied to the lever 67 in the state where the second engaged portion 67A and the second engaging portion 106 are engaged with each other, a force is applied from the second engaged portion 67A to the second engaging portion 106. Here, the nearer to the pivotal axis center P2 of the lock member 100 the position at which the force is applied is, the smaller the moment of the applied force is. This allows a reduced load to be applied to the second engaging portion 106, and prevents the lock member 100 from being damaged even if an operation force is applied to the lever 67 in the state where the second engaged portion 67A and the second engaging portion 106 are engaged with each other.

As shown in FIGS. 13A and 13B, the lever 67 includes a first extended portion 671. The first extended portion 671 includes a slidably contacted portion 672 and an engaging portion 673. As shown in FIGS. 17A-17D and FIGS. 18A-18D, the slidably contacted portion 672 has a curved shape extending in a pivoting direction from the first operation position to the second operation position of the lever 67. The engaging portion 673 is provided on the upper surface of the slidably contacted portion 672 and projects upward. An upper end of the engaging portion 673 slides on an upper inner wall surface 721 of the cover 72 when the lever 67 is pivoted (see FIGS. 18A-18D). When the lever 67 is pivoted, the first extended portion 671 is pivoted (displaced) in the pivoting direction of the lever 67.

As shown in FIGS. 12A and 12B, the lock member 100 includes a second extended portion 110. The second extended portion 110 includes an elastic deformation portion 111 and a slidably contacting portion 112. The elastic deformation portion 111 extends out from the main body of the lock member 100 in such a way as to have an approximate shape of letter L in a cross section taken along a plane that passes through the pivotal axis center P2. The slidably contacting portion 112 is formed to project upward from a tip of a free end of the elastic deformation portion 111. The slidably contacting portion 112 is in an approximate triangular shape having inclined portions that are inclined with respect to the pivoting direction of the first extended portion 671. The inclined portions are provided on both sides of the slidably contacting portion 112 in a direction along an arcing trajectory drawn by the first extended portion 671 when the lever 67 pivots. In the present embodiment, the slidably contacting portion 112 includes a top portion 1121 and inclined portions 1122 and 1123. It is noted that the shape of the slidably contacting portion 112 is not limited to a triangle, but may be a trapezoid.

Figures 18A, 18B, 18C, 18D:
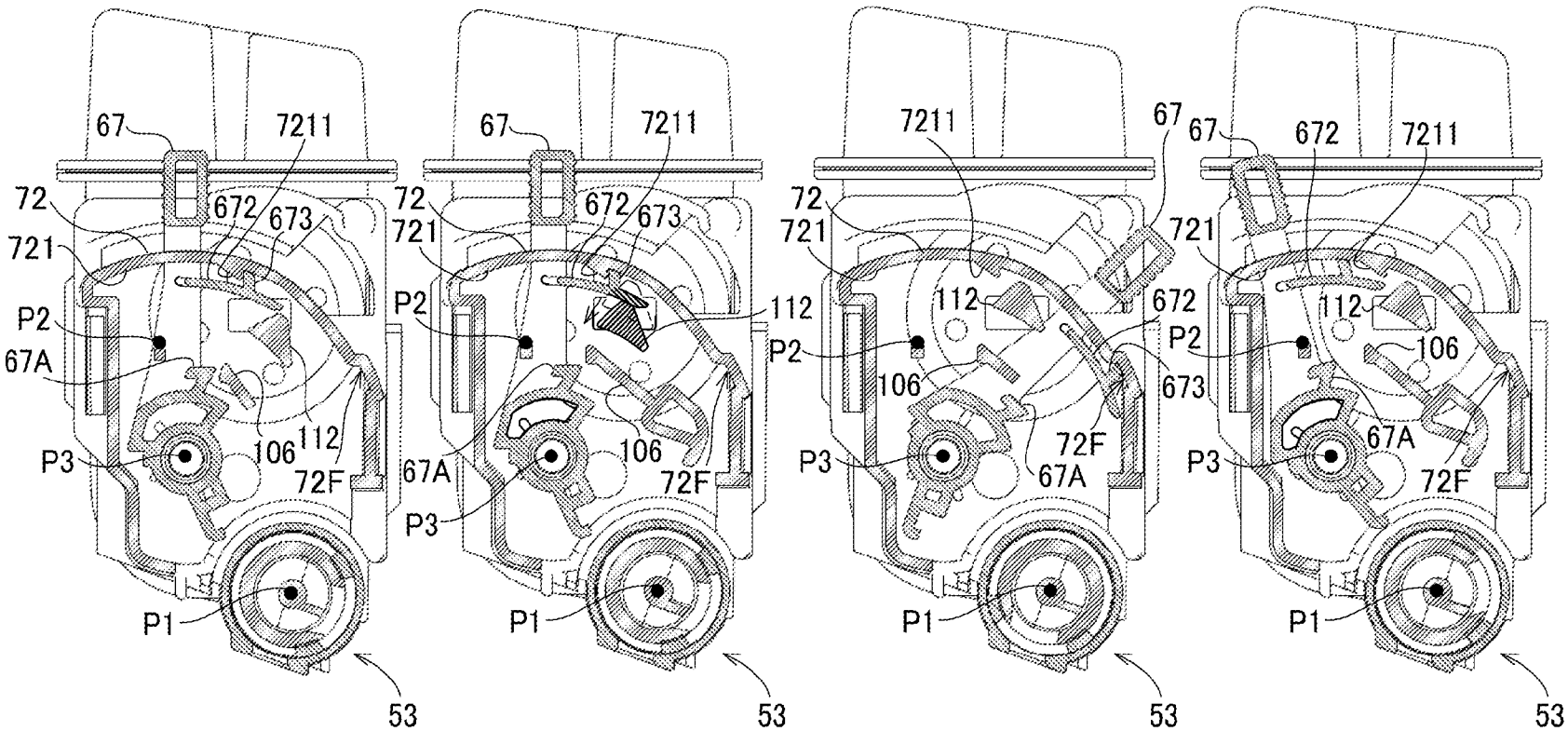
FIGS. 18A-18D are cross-sectional views of the toner container taken along a plane that is perpendicular to a pivoting axis center P3 and passes through the slidably contacting portion and the engaging portion.

As shown in FIG. 18C and FIG. 18D, the slidably contacting portion 112 does not abut on another member when the lever 67 is at the first operation position or the second operation position. When the lock member 100 is pushed upward from the lock position by the projection portion 46, the slidably contacting portion 112 enters the movement trajectory of the slidably contacted portion 672 of the first extended portion 671 in the pivoting of the lever 67. As a result, when, after the lock by the lock member 100 is released, the lever 67 is pivotally operated from the first operation position to the second operation position, the slidably contacted portion 672 abuts on the slidably contacting portion 112.

Figure 16A:
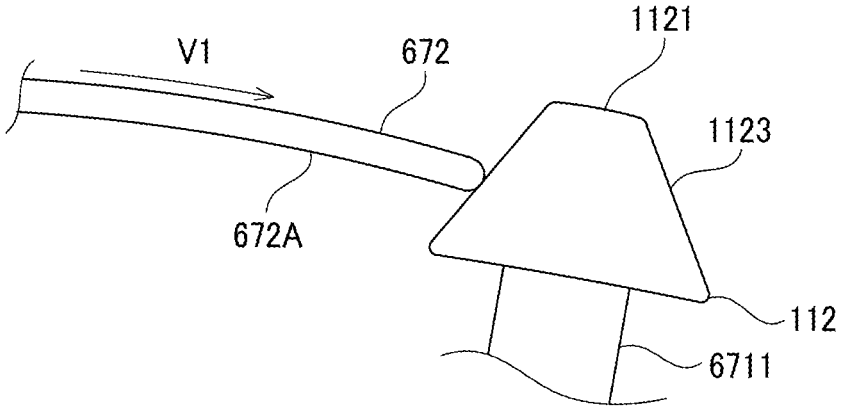
FIGS. 16A-16C are diagrams for explaining the contact state between a slidably contacting portion and a slidably contacted portion in correspondence with the pivoting state of the lever.
Figure 16B:
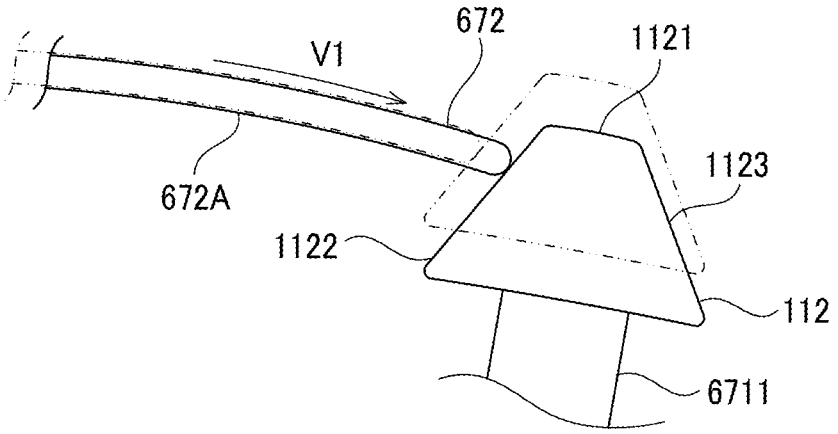
Figure 16C:
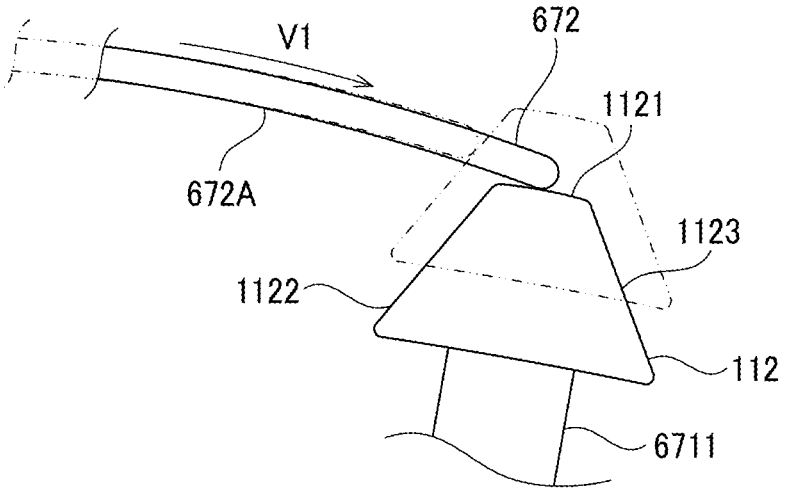

Here, the distance from the pivotal axis center P3 of the lever 67 to a slidably contacted surface 672A is shorter than the distance from the pivotal axis center P3 to the top portion 1121 of the slidably contacting portion 112. As a result, when the lever 67 is pivotally operated from the third operation position toward the first operation position in the state where the toner container 50 is not attached, the slidably contacted portion 672 abuts on the inclined portions 1122 and 1123 of the slidably contacting portion 112 as shown in FIG. 16A, and pushes and displaces the lock member 100 in the direction indicated by the arrow V1. With this displacement, the lock member 100 reaches the lock position where the first engaged portion 61A and the first engaging portion 104 are engaged with each other, and the opening/closing mechanism 53 is locked to the closing position. When the toner container 50 is set to the attached attitude, the lock member 100 is displaced to the unlock position. As shown in FIGS. 16B and 16C, when, in this state, the lever 67 is further pivotally operated by the guide function of the inclined portions 1122 and 1123 of the slidably contacting portion 112, the second extended portion 110 slides on the slidably contacted surface 672A while being elastically deformed such that the slidably contacting portion 112 gradually approaches the pivotal axis center P2, and the slidably contacted portion 672 is guided smoothly. Subsequently, as shown in FIG. 16C, the top portion 1121 of the slidably contacting portion 112 abuts on the slidably contacted surface 672A of the slidably contacted portion 672.

When the lever 67 is pivotally operated from the first operation position (the position indicated in FIG. 17A) to the second operation position (the position indicated in FIG. 17C), the top portion 1121 of the slidably contacting portion 112 slidably contacts the slidably contacted surface 672A of the slidably contacted portion 672. Furthermore, when the lever 67 is operated to pivot from the second operation position to the first operation position, or to pivot from the first operation position to the second operation position, the slidably contacting portion 112 and the slidably contacted portion 672 are moved away from each other as shown in FIG. 18C. That is, the first extended portion 671 slidably contact the inclined portions 1122 and 1123 until it is in contact with the end portion of the slidably contacting portion 112 in the diameter direction.

Meanwhile, in a conventional image forming apparatus, as a mechanism for providing the user with an operation feeling, a mechanism is adopted which always gives a resisting force to the lever 67 when the lever 67 is pivotally operated such that the user feels a load (resistance). However, according to this mechanism, when a member that gives the resisting force to the lever 67 does not have an enough strength, the member is deformed by the reaction force from the lever 67 during the operation of the lever 67 and fails to convey enough load to the user. In addition, since the member always receives the resisting force, the member may be damaged due to the lack of durability.

On the other hand, in the present embodiment, from the time when the top portion 1121 of the slidably contacting portion 112 starts to slide on the slidably contacted surface 672A until it moves away from the slidably contacted surface 672A, the slidably contacting portion 112 that is elastically deformed biases the lever 67 toward the first operation position via the slidably contacted surface 672A. This allows a resisting force to be given to the user's pivotal operation of the lever 67. On the other hand, when the lever 67 reaches the second operation position from the first operation position, or reaches the first operation position from the second operation position, the top portion 1121 of the slidably contacting portion 112 moves away from the slidably contacted surface 672A of the slidably contacted portion 672, and the resisting force disappears. In this way, the force required to operate the lever 67 greatly differs between when the lever 67 has reached the first operation position or the second operation position and when the lever 67 is being operated until it reaches there. This makes it possible to reduce the operation load for the lever 67, and improve the durability of the lever 67. Furthermore, this allows the user to feel that the lever 67 has reached the first operation position or the second operation position, and receive an excellent operation feeling via the lever 67.

As shown in FIG. 18C, when the lever 67 reaches from the first operation position to the second operation position, the engaging portion 673 is fitted in a recessed portion 72F provided at a predetermined position of the cover 72. The recessed portion 72F has a predetermined depth such that the user requires a slightly strong force to pivotally operate the lever 67 from the second operation position to the first operation position. As a result, the lever 67 is held at the second operation position as far as a pivotal force smaller than the above-mentioned pivotal force is acted on the lever 67. It is noted that in the present embodiment, as shown in FIG. 18C, the recessed portion 72F has a certain length in the pivoting direction of the lever, and thus the lever 67 is pivotable in a very small angle range. However, even if the lever 67 is pivoted within the very small angle range, the opening/closing mechanism 53 is held at the opening position.

Figure 14A:
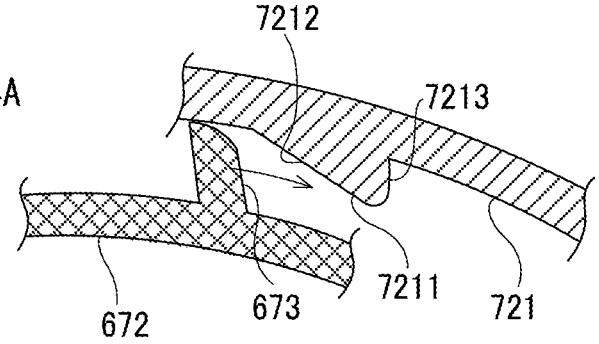
FIGS. 14A-14D are diagrams for explaining the engagement mechanism of the cover and the lever.
Figure 14B:
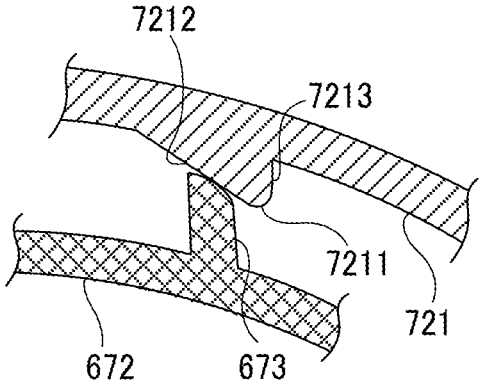
Figure 14C:
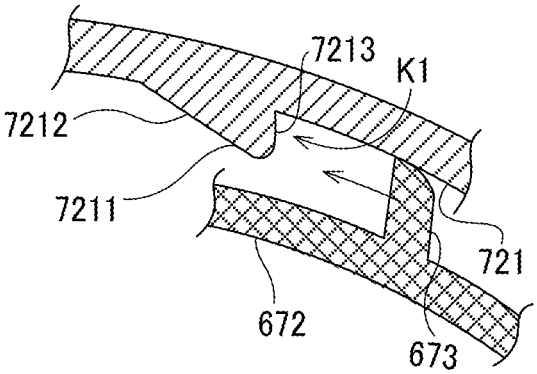
Figure 14D:
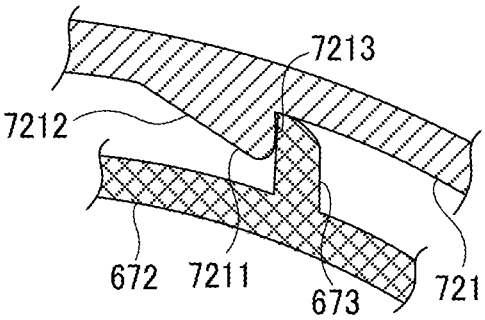

As shown in FIGS. 14A-14D and FIGS. 18A-18D, the cover 72 includes an engaged portion 7211. Here, FIGS. 18A-18D are cross-sectional views, viewed from the right side, of the right end portion of the housing 51 taken along a plane that is perpendicular to the left-right direction 8 and passes through the engaged portion 7211. In addition, FIGS. 14A-14D are partially enlarged views of the engaged portion 7211 and the engaging portion 673 in FIGS. 18A-18D. The engaged portion 7211 is a projecting portion provided on the upper inner wall surface 721 of the cover 72. As shown in FIGS. 14A and 14B, the engaged portion 7211 has an inclined surface 7212 which the upper end of the engaging portion 673 can climb when slidably contacting the upper inner wall surface 721 of the cover 72 when the lever 67 is pivoted from the third operation position toward the second operation position via the first operation position. On the other hand, as shown in FIGS. 14C and 14D, the engaged portion 7211 has a vertical wall surface 7213 which the upper end of the engaging portion 673 cannot climb when the lever 67 is pivoted from the second operation position to the first operation position. The engaging portion 673 is fitted in a space K1 defined by the upper inner wall surface 721 and the vertical wall surface 7213 of the engaged portion 7211 (see FIG. 14C), and the further pivoting of the lever 67 is restricted.

With the above-described configuration, once the lever 67 is pivoted from the third operation position to the first operation position or the second operation position, the lever 67 cannot be returned to the third operation position. The first operation position is a position where the engaged portion 7211 is engaged with the engaging portion 673 of the first extended portion 671.

Figure 15A:
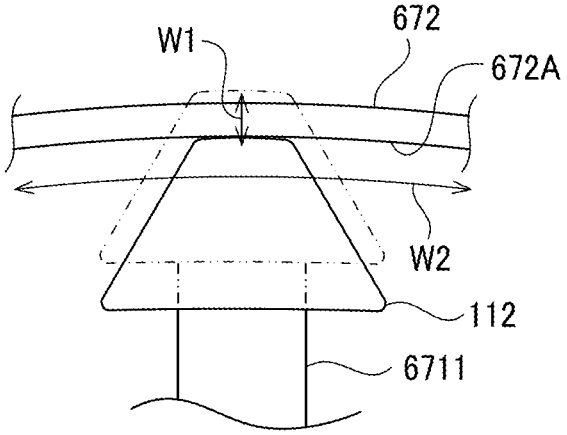
FIGS. 15A-15C are diagrams for explaining acts of a second extended portion.

A thickness X (see FIG. 12B) of the elastic deformation portion 111 of the second extended portion 110 is relatively small, and as described above, the elastic deformation portion 111 can be elastically deformed in a diameter direction (indicated by the arrow W1 of FIG. 15A) of an arcing trajectory drawn by the slidably contacted portion 672 when the first extended portion 671 is displaced as the lever 67 is pivoted. On the other hand, a width Y (see FIG. 12B) of the elastic deformation portion 111 is relatively large, and at least larger than the thickness X. As a result, the rigidity of the elastic deformation portion 111 is higher in the direction along the trajectory (arrow W2) than in the diameter direction (arrow W1). Accordingly, the elastic deformation portion 111 is likely to be elastically deformed in the arrow W1 direction, but is difficult to be elastically deformed in the arrow W2 direction.

Figure 15B:
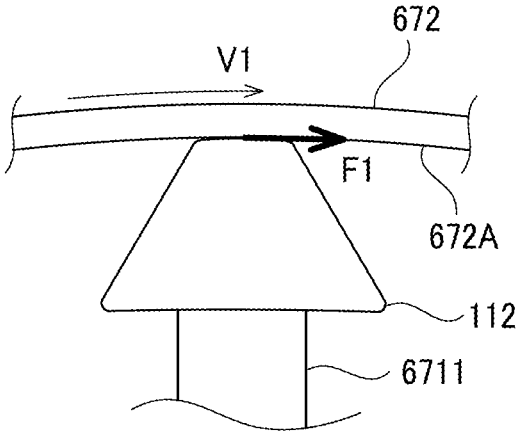
Figure 15C:
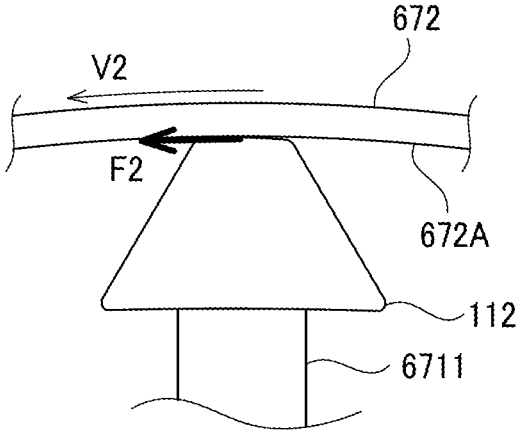

In the present embodiment, since the second extended portion 110 has a high rigidity in the trajectory direction (arrow W2), the following effect is produced. That is, as shown in FIG. 15B, when the slidably contacted portion 672 of the first extended portion 671 moves in the arrow V1 direction as the lever 67 is pivoted from the first operation position to the second operation position, a friction force is generated between the slidably contacted portion 672 and the slidably contacting portion 112. The friction force acts on the elastic deformation portion 111 as a force F1 that biases the elastic deformation portion 111 in an opposite direction to the friction force. However, since the second extended portion 110 has a high rigidity in the trajectory direction (arrow W2), even if the force F1 acts, the second extended portion 110 does not bend in the W2 direction with respect to the main body of the lock member 100. Similarly, as shown in FIG. 15C, when the slidably contacted portion 672 of the first extended portion 671 moves in the arrow V2 direction as the lever 67 is pivoted from the second operation position to the first operation position, a force F2 that biases the elastic deformation portion 111 in the W2 direction acts on the elastic deformation portion 111. However, even if the force F2 acts, the second extended portion 110 does not bend in the W2 direction with respect to the main body of the lock member 100. In this way, since the second extended portion 110 has a rigidity that is enough not to allow the second extended portion 110 to bend in the W2 direction with respect to the main body of the lock member 100, the slidably contacted portion 672 smoothly slides on the slidably contacting portion 112, and an excellent operability of the lever 67 is provided.

Figure 20A:
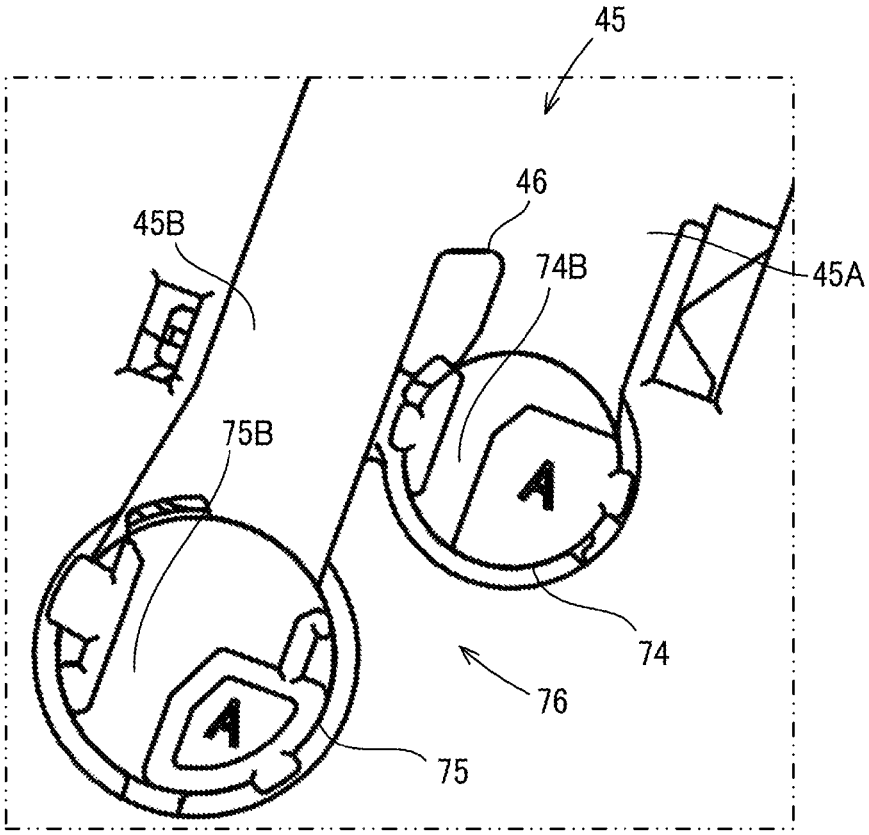
FIGS. 20A and 20B are enlarged views of a drive transmission mechanism.
Figure 20B:
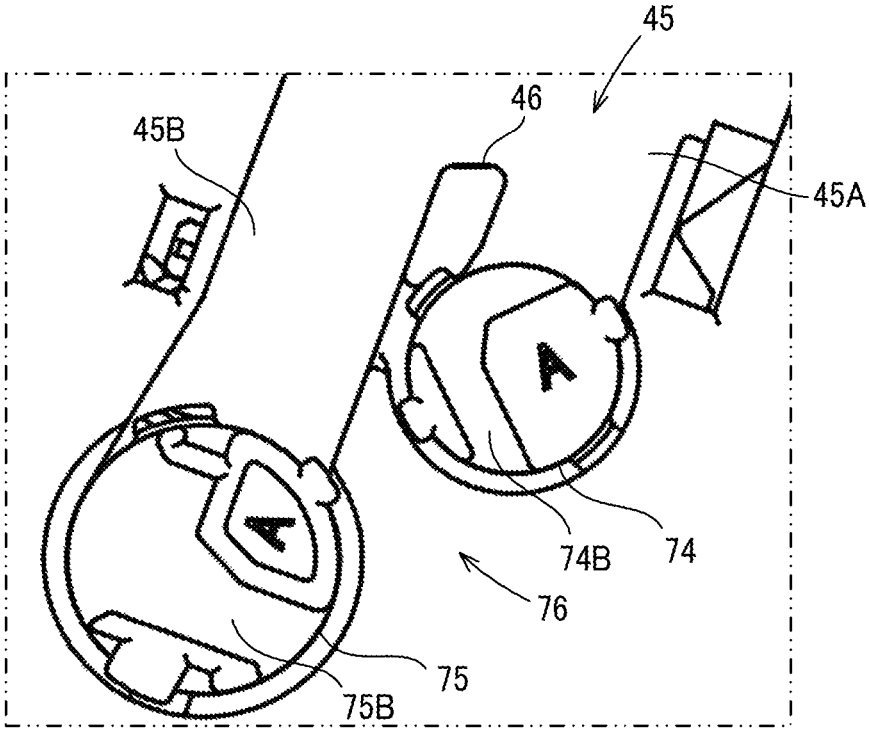
Figure 21:
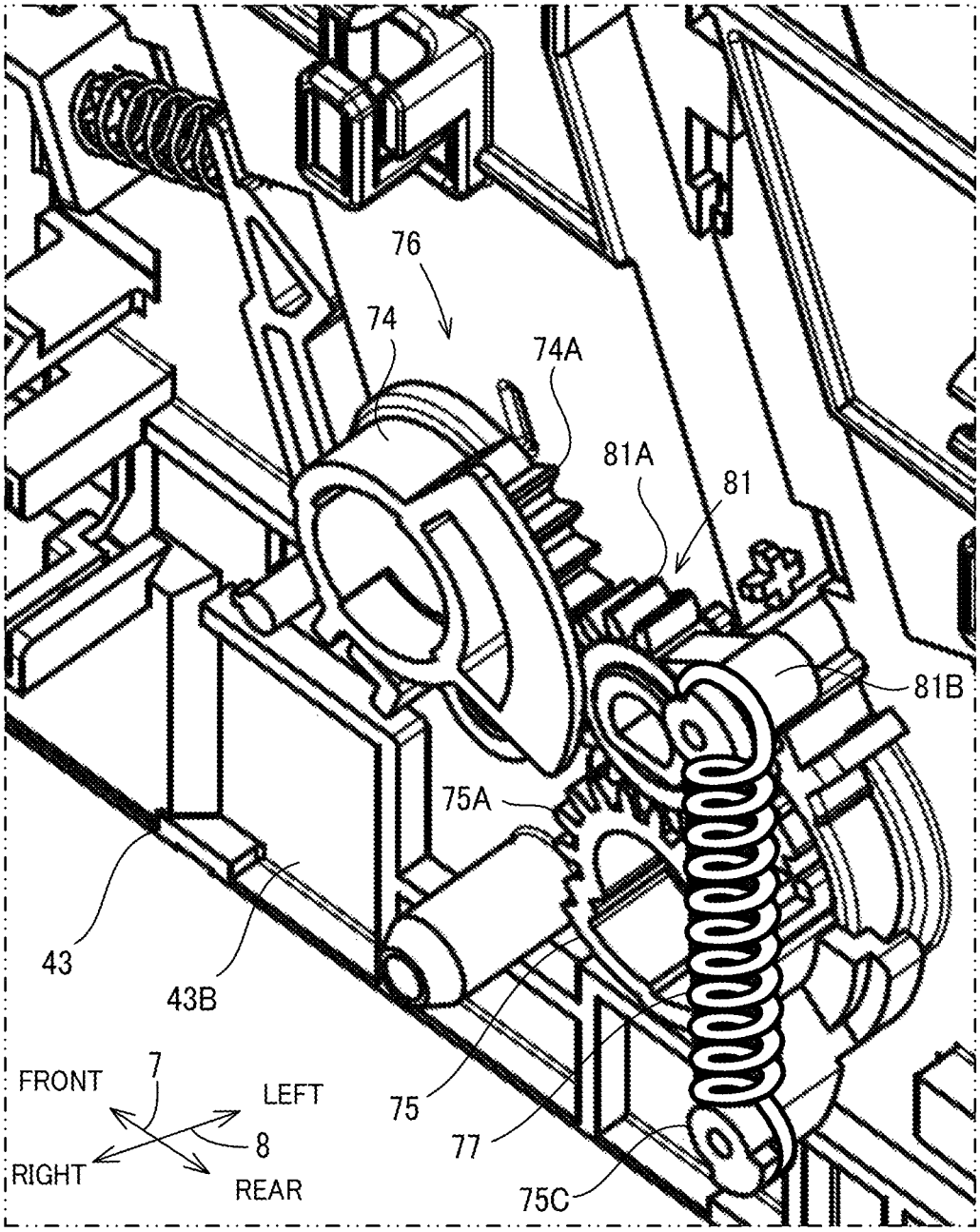
FIG. 21 is a perspective view showing the drive transmission mechanism in enlargement.
Figure 22A:
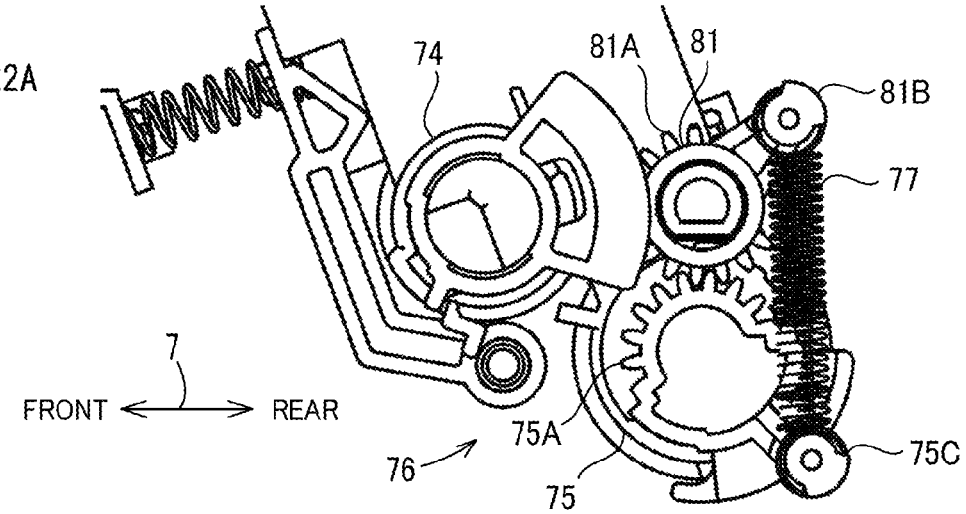
FIGS. 22A-22C are diagrams for explaining the operation of the drive transmission mechanism.
Figure 22B:
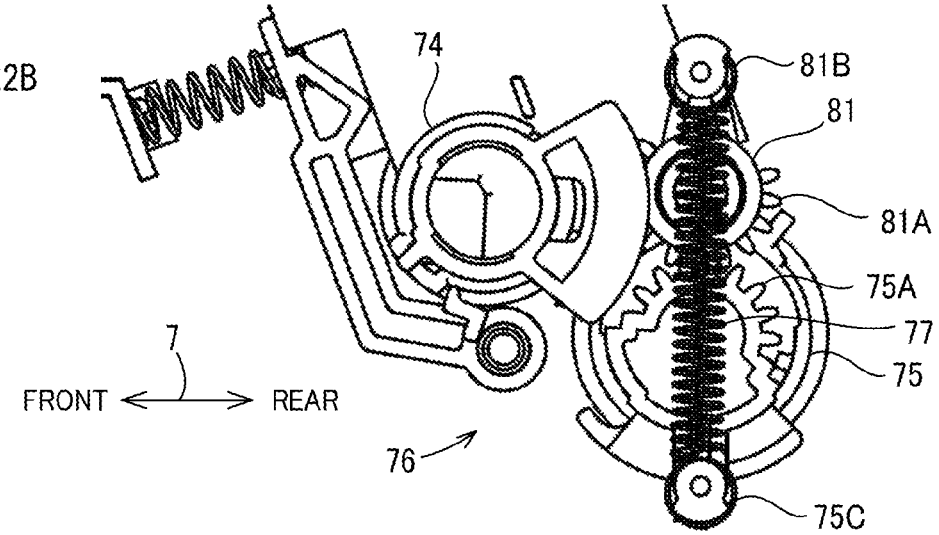
Figure 22C:
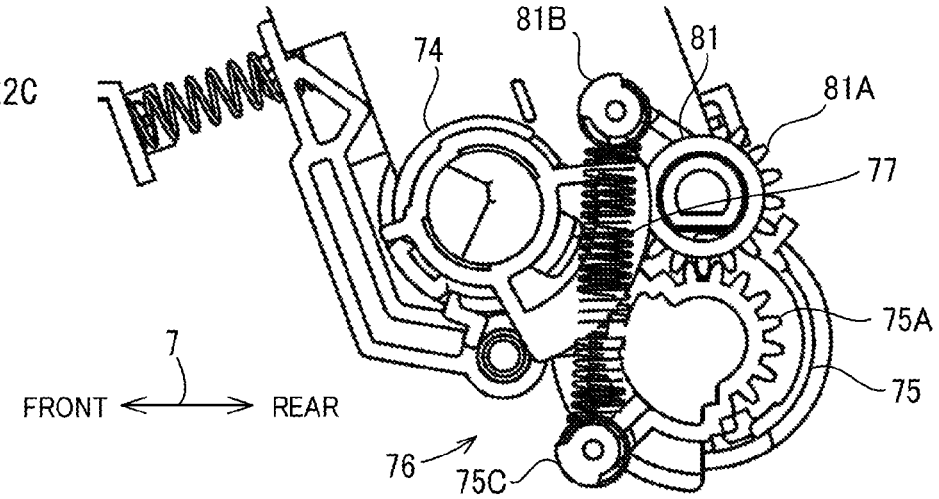

FIG. 19 shows an outer appearance of the support plate 43. FIGS. 20A, 20B, and 21 are enlarged views of the drive transmission mechanism 76. FIGS. 22A-22C are diagrams for explaining the operation of the drive transmission mechanism 76. It is noted that FIG. 19 shows the support plate 43 viewed from the left side. FIGS. 20A and 20B are enlarged views of the peripheral of one container guide 45 in FIG. 19. It is noted that FIG. 21 shows the support plate 43 viewed from the right side. FIG. 22A shows the state where the lever 67 is positioned at the first operation position. FIG. 22B shows the state where the lever 67 is positioned at a middle position between the first operation position and the second operation position. FIG. 22C shows the state where the lever 67 is positioned at the second operation position.

As shown in FIG. 19, the drive transmission mechanism 76 is provided on the right side surface 43B of the support plate 43. The lower portion of each container guide 45 branches into a first groove portion 45A and a second groove portion 45B. The projection portion 46 is formed between the first groove portion 45A and the second groove portion 45B so as to extend along the first groove portion 45A and the second groove portion 45B.

When the cover 72 is guided diagonally downward in the attachment direction by the container guide 45, the projection portion 46 is inserted in the guide groove 72E of the cover 72. Subsequently, the upper end of the projection portion 46 as a projection abuts on the pressed portion 105 of the lock member 100 and pushes the lock member 100 upward. In this way, when the toner container 50 is attached to the support plate 43, the lock member 100 abuts on the projection portion 46 and operates in the lock release direction, so that the lock state of the operation portion 54 and the opening/closing mechanism 53 by the lock member 100 is released.

As shown in FIGS. 20A, 20B, and 21, the drive transmission mechanism 76 is provided in the apparatus main body 28. The drive transmission mechanism 76 is provided on the support plate 43 that constitutes a part of the apparatus main body 28. In the present embodiment, four drive transmission mechanisms 76 are provided in correspondence with four toner containers 50. The drive transmission mechanisms 76 are provided in alignment in the front-rear direction 7 on the right side surface 43B of the support plate 43.

The drive transmission mechanism 76 is configured such that, when the lever 67 of the operation portion 54 is operated and an operation driving force (a driving force) is input in the state where the toner container 50 is attached to the support plate 43, the drive transmission mechanism 76 transmits the operation driving force to the opening/closing mechanism 53.

The drive transmission mechanism 76 includes a first rotation portion 74 (input transmission portion), an intermediate rotation portion 81 (intermediate transmission portion), and a second rotation portion 75 (output transmission portion). The first rotation portion 74 is a portion that receives the operation driving force input from the operation portion 54 when the lever 67 of the operation portion 54 is operated. Upon receiving the operation driving force, the first rotation portion 74 transmits the operation driving force to the intermediate rotation portion 81. The intermediate rotation portion 81 is a portion that receives, from the first rotation portion 74, the operation driving force input by the operation of the lever 67 of the operation portion 54 and transmits the received operation driving force to the second rotation portion 75. The second rotation portion 75 is a portion that receives the operation driving force from the intermediate rotation portion 81 and outputs (transmits) the operation driving force to an external device (the opening/closing mechanism 53). In other words, the second rotation portion 75 receives the operation driving force transmitted from the first rotation portion 74 via the intermediate rotation portion 81, and outputs (transmits) the operation driving force to an external device (the opening/closing mechanism 53). The first rotation portion 74 is configured to rotate upon receiving the operation driving force. The intermediate rotation portion 81 is configured to rotate in conjunction with the first rotation portion 74. The second rotation portion 75 is configured to rotate in conjunction with the first rotation portion 74 and the intermediate rotation portion 81.

The first rotation portion 74 is disposed at the lower end of the first groove portion 45A of the container guide 45, and is rotatably supported by the support plate 43. On the other hand, the second rotation portion 75 is disposed at the lower end of the second groove portion 45B, and is rotatably supported by the support plate 43. The first rotation portion 74 and the second rotation portion 75 are separated from each other and are not configured to directly transmit the driving force to each other. The intermediate rotation portion 81 is provided between the first rotation portion 74 and the second rotation portion 75, and the intermediate rotation portion 81 is rotatably supported by the support plate 43. The intermediate rotation portion 81 is connected so as to be able to transmit a driving force to the first rotation portion 74 and the second rotation portion 75.

As shown in FIG. 21, the first rotation portion 74 is a rotator and includes a first gear portion 74A. The second rotation portion 75 is a rotator and includes a second gear portion 75A (gear portion). The intermediate rotation portion 81 is a rotator and includes an intermediate gear portion 81A (gear portion) that meshes with the first gear portion 74A and the second gear portion 75A respectively. The first gear portion 74A is integrally formed with the first rotation portion 74. The intermediate gear portion 81A is integrally formed with the intermediate rotation portion 81. The second gear portion 75A is integrally formed with the second rotation portion 75. As a result, when the first rotation portion 74 rotates in the state where the first gear portion 74A and the intermediate gear portion 81A mesh with each other and the intermediate gear portion 81A and the second gear portion 75A mesh with each other, the intermediate rotation portion 81 rotates reversely with respect to the rotational direction of the first rotation portion 74, and the second rotation portion 75 rotates in the same direction as the first rotation portion 74.

In the present embodiment, the first gear portion 74A and the second gear portion 75A are set such that the first rotation portion 74 and the second rotation portion 75 have the same rotation angle. Specifically, the first gear portion 74A and the second gear portion 75A are formed to have the same number of teeth and the same pitch. As a result, for example, the first gear portion 74A and the second gear portion 75A are set such that when the first rotation portion 74 rotates 45 degrees together with the lever 67, the second rotation portion 75 also rotates 45 degrees.

In addition, as shown in FIG. 21, the drive transmission mechanism 76 includes a spring 77 (biasing member). The spring 77 biases the opening/closing mechanism 53 toward the closing position via the second rotation portion 75 when the lever 67 is positioned at the first operation position in the state where the toner container 50 is attached to the attachment portion 34. Furthermore, the spring 77 biases the opening/closing mechanism 53 toward the opening position via the second rotation portion 75 when the lever 67 is positioned at the second operation position in the state where the toner container 50 is attached to the attachment portion 34.

The spring 77 intervenes between the intermediate rotation portion 81 and the second rotation portion 75. The spring 77 is, for example, a coil spring. In the present embodiment, the spring 77 is attached in such a way as to be stretched and compressed with the rotation of the intermediate rotation portion 81 and the second rotation portion 75 in response to an operation of the lever 67. Specifically, the intermediate rotation portion 81 includes a first support piece 81B projecting outward in the radial direction from the outer circumferential surface thereof. The first support piece 81B is a portion to which one end portion of the spring 77 is fixed. That is, the first support piece 81B supports one end of the spring 77. Since the first support piece 81B pivots as the intermediate rotation portion 81 rotates, when the intermediate rotation portion 81 rotates, the position of the first support piece 81B supporting the spring 77 changes. The second rotation portion 75 includes a second support piece 75C projecting outward in the radial direction from the outer circumferential surface thereof. The second support piece 75C is a portion to which the other end portion of the spring 77 is fixed. That is, the second support piece 75C supports the other end of the spring 77. Since the second support piece 75C pivots as the intermediate rotation portion 81 rotates, when the intermediate rotation portion 81 rotates, the position of the second support piece 75C supporting the spring 77 changes.

As shown in FIG. 21, the spring 77 is attached between the first support piece 81B and the second support piece 75C. The spring 77 always generates a spring force in the compression direction, and is a so-called tension spring. In the present embodiment, as shown in FIG. 22B, when the first support piece 81B and the second support piece 75C are disposed on a line segment connecting between the center of the intermediate rotation portion 81 and the center of the second rotation portion 75, the spring force of the spring 77 is balanced, and the intermediate rotation portion 81 and the second rotation portion 75 maintain the stationary state. In this state, the spring 77 is maximally stretched. The positions of the lever 67 and the cylinder 61 when the spring force of the spring 77 is balanced are determined in advance. Specifically, in this state, the lever 67 is positioned at an intermediate position between the first operation position and the second operation position, and the cylinder 61 is positioned at an intermediate position between the opening position and the closing position. Here, the intermediate position of the lever 67 is an example of the predetermined position in an operation range of the lever 67 except for the first operation position and the second operation position.

In the state shown in FIG. 22B, when the lever 67 is operated from the intermediate position toward the first operation position, the balance of the spring 77 is released. Specifically, with the operation of the lever 67, the first rotation portion 74 allows the intermediate rotation portion 81 to rotate clockwise, and the intermediate rotation portion 81 allows the second rotation portion 75 to rotate counterclockwise. In this case, as shown in FIG. 22A, the spring 77 applies a force in the compression direction in such a way as to allow the intermediate rotation portion 81 to further rotate clockwise and allow the second rotation portion 75 to further rotate counterclockwise. At this time, even if no operation driving force is input to the lever 67 after it is operated from the intermediate position, the intermediate rotation portion 81 and the second rotation portion 75 are rotated only by the force of the spring 77. This allows the rotation of the second rotation portion 75 to be transmitted to the cylinder 61, and the cylinder 61 is displaced to the opening position by the biasing force of the spring 77 in a reliable manner.

On the other hand, in the state shown in FIG. 22B, when the lever 67 is operated from the intermediate position toward the second operation position, the balance of the spring 77 is released. Specifically, with the operation of the lever 67, the first rotation portion 74 allows the intermediate rotation portion 81 to rotate counterclockwise, and the intermediate rotation portion 81 allows the second rotation portion 75 to rotate clockwise. In this case, as shown in FIG. 22C, the spring 77 applies a force in the compression direction in such a way as to allow the intermediate rotation portion 81 to further rotate counterclockwise and allow the second rotation portion 75 to further rotate clockwise. At this time, even if no operation driving force is input to the lever 67 after it is operated from the intermediate position, the intermediate rotation portion 81 and the second rotation portion 75 are rotated only by the force of the spring 77. This allows the rotation of the second rotation portion 75 to be transmitted to the cylinder 61, and the cylinder 61 is displaced to the closing position by the biasing force of the spring 77 in a reliable manner.

As shown in FIG. 4 to FIG. 6, the operation portion 54 includes the first coupling portion 78. The first coupling portion 78 is rotated when the lever 67 is operated. The first coupling portion 78 is integrally formed with the right end portion of the shaft 66. The first coupling portion 78 is formed in the shape of a plate that projects rightward from the right end of the shaft 66. The first coupling portion 78 extends in the attachment direction (namely, diagonally downward) in which the cover 72 is guided by the container guide 45 when the housing 51 is attached to the support plate 43. The first coupling portion 78 is coupled with the first rotation portion 74 of the drive transmission mechanism 76 in the state where the toner container 50 is attached to the container guide 45 of the support plate 43. That is, the first coupling portion 78 is coupled with the first rotation portion 74 in the state where the toner container 50 is attached. With this configuration, the operation driving force that is input when the operation portion 54 is operated is transmitted to the first rotation portion 74.

As shown in FIG. 20A and FIG. 20B, a first coupling groove 74B is formed in the first rotation portion 74 of the drive transmission mechanism 76 such that the first coupling portion 78 of the toner container 50 is coupled with the first coupling groove 74B. The first coupling groove 74B extends straight at least in part. On the other hand, the first coupling portion 78 is shaped so as to be fitted in the first coupling groove 74B. That is, the groove width of the first coupling groove 74B is approximately the same as the thickness of the first coupling portion 78. When the housing 51 is attached to the apparatus main body 28, the first coupling portion 78 is inserted into the first coupling groove 74B and is coupled therewith so that it can be integrally rotated with the first rotation portion 74.

As shown in FIG. 4 to FIG. 6, the opening/closing mechanism 53 of the toner container 50 includes the second coupling portion 79 that integrally rotates with the cylinder 61. The second coupling portion 79 is integrally formed with the right end portion of the cylinder 61. The second coupling portion 79 projects rightward from the right end of the cylinder 61. The second coupling portion 79 is formed in a shape of a hook in a cross section taken along a line that is perpendicular to the axis direction of the cylinder 61. The second coupling portion 79 receives the operation driving force from the second rotation portion 75 of the drive transmission mechanism 76. The second coupling portion 79 is coupled with the second rotation portion 75 of the drive transmission mechanism 76 in the state where the toner container 50 is attached to the container guide 45 of the support plate 43. That is, the second coupling portion 79 is coupled with the second rotation portion 75 in the state where the toner container 50 is attached. This enables the operation driving force to be transmitted to the second coupling portion 79 via the first rotation portion 74, the intermediate rotation portion 81 and the second rotation portion 75.

The second coupling portion 79 extends in the attachment direction (namely, diagonally downward) in which the cover 72 is guided by the container guide 45 when the housing 51 is attached to the support plate 43. The second coupling portion 79 is larger in thickness than the first coupling portion 78.

As shown in FIG. 20A and FIG. 20B, a second coupling groove 75B is formed in the second rotation portion 75 of the drive transmission mechanism 76 such that the second coupling portion 79 of the toner container 50 is coupled with the second coupling groove 75B. The second coupling groove 75B extends straight at least in part. On the other hand, the second coupling portion 79 (see FIG. 4 to FIG. 6) is shaped so as to be fitted in the second coupling groove 75B. That is, the groove width of the second coupling groove 75B is approximately the same as the thickness of the second coupling portion 79. As a result, the second coupling groove 75B and the first coupling groove 74B are different in groove width. When the housing 51 is attached to the support plate 43, the second coupling portion 79 is inserted into the second coupling groove 75B, and is coupled therewith so that it can be integrally rotated with the second rotation portion 75. The opening/closing mechanism 53 is configured such that the second coupling portion 79 and the second rotation portion 75 integrally rotate with each other, thereby the cylinder 61 is rotated in such a way as to open and close the toner discharge outlet 52.

Next, description is given of the attachment/detachment operation of the toner container 50 with respect to the apparatus main body 28.

Figure 8B:
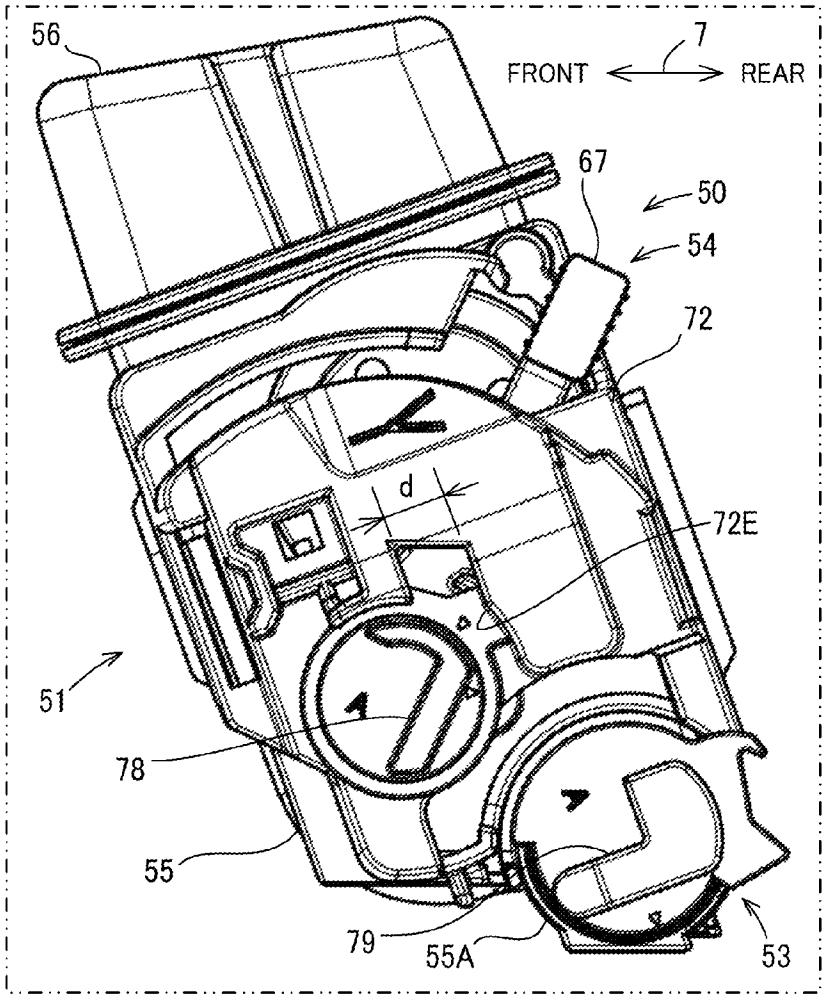
FIG. 8A and FIG. 8B are perspective views showing the positions of a first coupling portion and a second coupling portion corresponding to the operation positions of the lever of the operation portion.
Figure 8A:
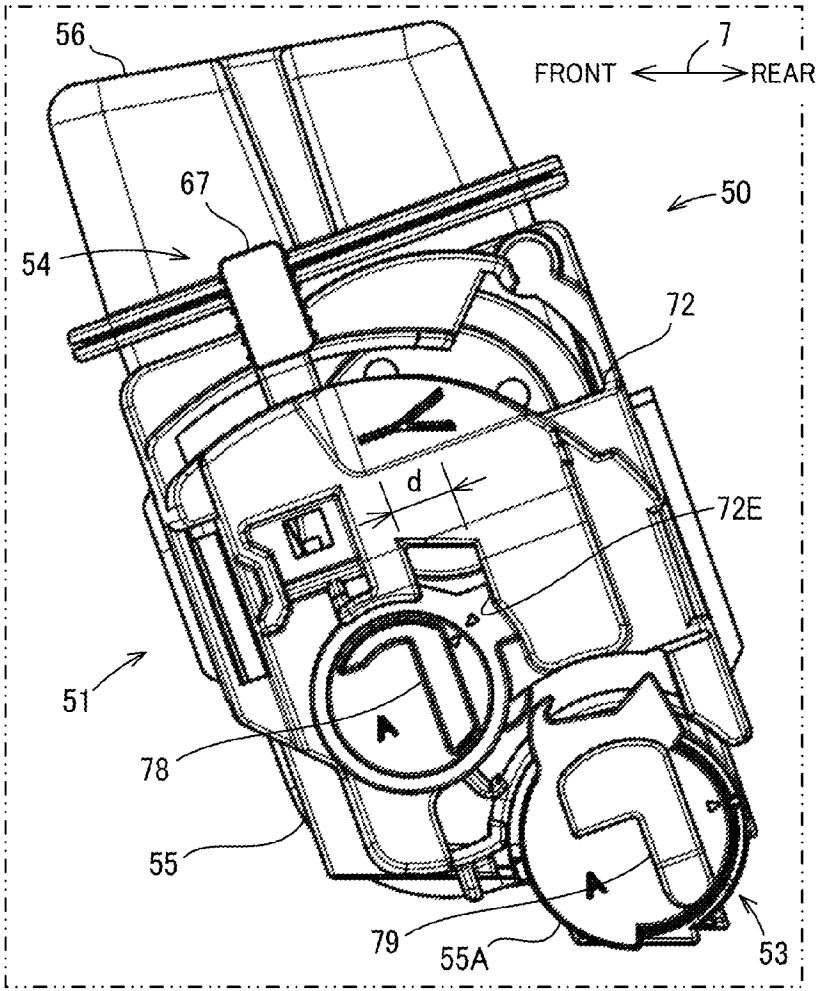

Before the toner container 50 is attached to the apparatus main body 28, the toner discharge outlet 52 is closed by the cylinder 61, and the operation portion 54 and the opening/closing mechanism 53 are in the lock state by the lock member 100. At this time, as shown in FIG. 8A, the first coupling portion 78 and the second coupling portion 79 extend in the attachment direction (namely, diagonally downward) in which the cover 72 is guided by the container guide 45. In addition, the lever 67 is positioned at the first operation position, and the cylinder 61 is positioned at the closing position.

Furthermore, as shown in FIG. 8A, before the toner container 50 is attached to the apparatus main body 28, the first coupling groove 74B of the first rotation portion 74 and the second coupling groove 75B of the second rotation portion 75 in the drive transmission portion 76 extend in the same direction as the container guide 45 extends (namely, in the attachment direction in which the cover 72 is guided).

When the toner container 50 is attached to the support plate 43, the cover 72 is inserted into the container guide 45 of the support plate 43. The cover 72 is then guided diagonally downward by the container guide 45. The first coupling portion 78 of the toner container 50 is guided by the first groove portion 45A, and the second coupling portion 79 is guided by the second groove portion 45B. Subsequently, the first coupling portion 78 is coupled with the first coupling groove 74B of the first rotation portion 74, and the second coupling portion 79 is coupled with the second coupling groove 75B of the second rotation portion 75.

In addition, while the cover 72 is guided by the container guide 45, the upper end of the projection portion 46 abuts on the pressed portion 105 of the lock member 100 and pushes up the lock member 100. This allows the lock member 100 to be separated from both the opening/closing mechanism 53 and the lever 67, allows the opening/closing mechanism 53 to be pivoted to the opening position, allows the lever 67 to be pivoted to the second operation position, and allows the operation portion 54 and the opening/closing mechanism 53 of the toner container 50 to be released from the lock state when the first coupling portion 78 is coupled with the first rotation portion 74 and the second coupling portion 79 is coupled with the second rotation portion 75.

Next, the toner discharge outlet 52 is opened by pivoting the lever 67 of the operation portion 54. Specifically, the lever 67 is pivoted from the third operation position (see FIG. 17D, FIG. 18D) toward the second operation position (see FIG. 17C, FIG. 18C) via the first operation position.

When the lever 67 of the operation portion 54 is pivoted in the state where the toner container 50 is attached to the support plate 43, the operation driving force is input to the first coupling portion 78 via the shaft 66 of the operation portion 54. This allows the shaft 66 and the first coupling portion 78 to integrally rotate with the lever 67 clockwise (see FIG. 8, FIG. 17B). That is, the first coupling portion 78 rotates the same angle as the pivoting angle of the lever 67.

At this time, from the time when the top portion 1121 of the slidably contacting portion 112 starts to slidably contact the slidably contacted surface 672A of the slidably contacted portion 672 until it moves away from the slidably contacted surface 672A, the slidably contacting portion 112 biases the lever 67 toward the first operation position via the slidably contacted surface 672A. This allows a resisting force to be given to the user's pivotal operation of the lever 67. As a result, an excellent operation feeling is given to the user via the lever 67, and the user can clearly feel that the lever 67 has reached the second operation position.

As shown in FIG. 18C, when the lever 67 reaches from the first operation position to the second operation position, the engaging portion 673 is engaged with the recessed portion 72F provided at a predetermined position of the cover 72. This allows the lever 67 to be held at the second operation position.

The first coupling portion 78 integrally rotates with the first rotation portion 74 of the drive transmission portion 76 because the first coupling portion 78 is coupled with the first rotation portion 74. As shown in FIG. 19, in the apparatus main body 28 side, the first gear portion 74A of the first rotation portion 74 meshes with the intermediate gear portion 81A of the intermediate rotation portion 81, and the intermediate gear portion 81A meshes with the second gear portion 75A of the second rotation portion 75. This allows the operation driving force to be transmitted from the first rotation portion 74 to the second rotation portion 75 via the intermediate rotation portion 81, and the second rotation portion 75 rotates in the same rotation direction as the first rotation portion 74.

The second rotation portion 75 integrally rotates with the second coupling portion 79 of the toner container 50 because the second rotation portion 75 is coupled with the second coupling portion 79. With the rotation of the second coupling portion 79, the cylinder 61 integrally rotates with the second coupling portion 79 toward the opening position.

Figures 17A, 17B, 17C, 17D:
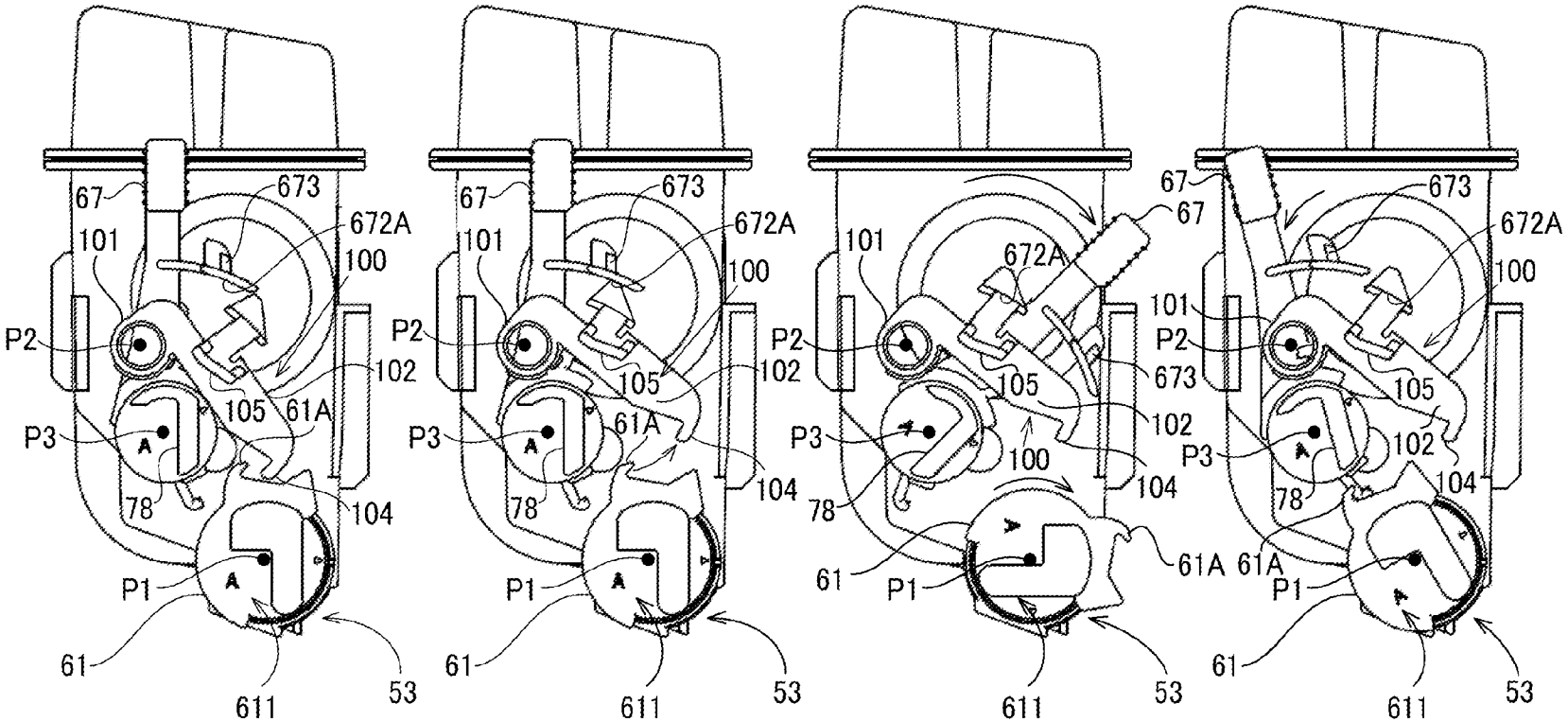
FIGS. 17A-17D are diagrams for explaining the pivoting position of the lever and the positions of the lock member and the like in the state where the cover is removed.

When the toner discharge outlet 52 is closed, the lever 67 is pivoted from the second operation position (see FIG. 8B, FIG. 17C) toward the first operation position (see FIG. 8A, FIG. 17C). This pivoting allows the shaft 66 and the first coupling portion 78 to integrally rotate with the lever 67 counterclockwise (see FIG. 8A). That is, the first coupling portion 78 rotates the same angle as the pivoting angle of the lever 67.

As shown in FIG. 19, in the apparatus main body 28 side, the operation driving force is transmitted from the first rotation portion 74 to the second rotation portion 75 via the intermediate rotation portion, and the second rotation portion 75 rotates in the same rotation direction as the first rotation portion 74. Here, since the second rotation portion 75 is coupled with the second coupling portion 79 of the toner container 50, the second coupling portion 79 integrally rotates with the second rotation portion 75. With the rotation of the second coupling portion 79, the cylinder 61 integrally rotates with the second coupling portion 79 toward the closing position.

At this time, from the time when the top portion 1121 of the slidably contacting portion 112 starts to slidably contact the slidably contacted surface 672A of the slidably contacted portion 672 until it moves away from the slidably contacted surface 672A, the slidably contacting portion 112 biases the lever 67 toward the second operation position via the slidably contacted surface 672A. This allows a resisting force to be given to the user's pivotal operation of the lever 67. As a result, an excellent operation feeling is given to the user via the lever 67, and the user can clearly feel that the lever 67 has reached the first operation position.

In addition, as shown in FIG. 20A, the engaging portion 673 is fitted in the engaged portion 7211 provided at a predetermined position of the cover 72, and the further pivoting of the lever 67 is restricted. This allows the lever 67 to be held at the first operation position.

Up to now, a preferable embodiment of the present disclosure has been described. However, the present disclosure is not limited to the embodiment described so far, but is applicable to various modifications.

The drive transmission mechanism 76 and the configuration for locking the lever 67 and the opening/closing mechanism 53 are not limited to the above-described embodiment, but the following modification is adoptable.

Figure 23:
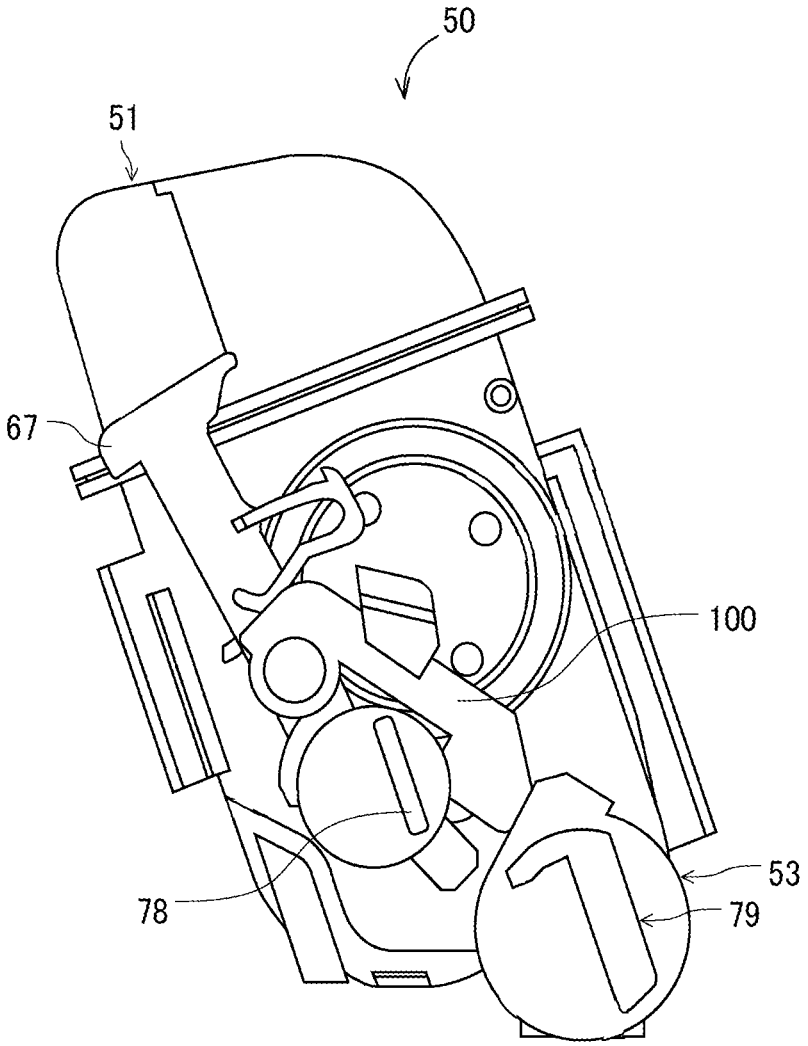
FIG. 23 is a side view showing a modification of a side surface of the toner container in the state where the cover is removed.
Figure 24:
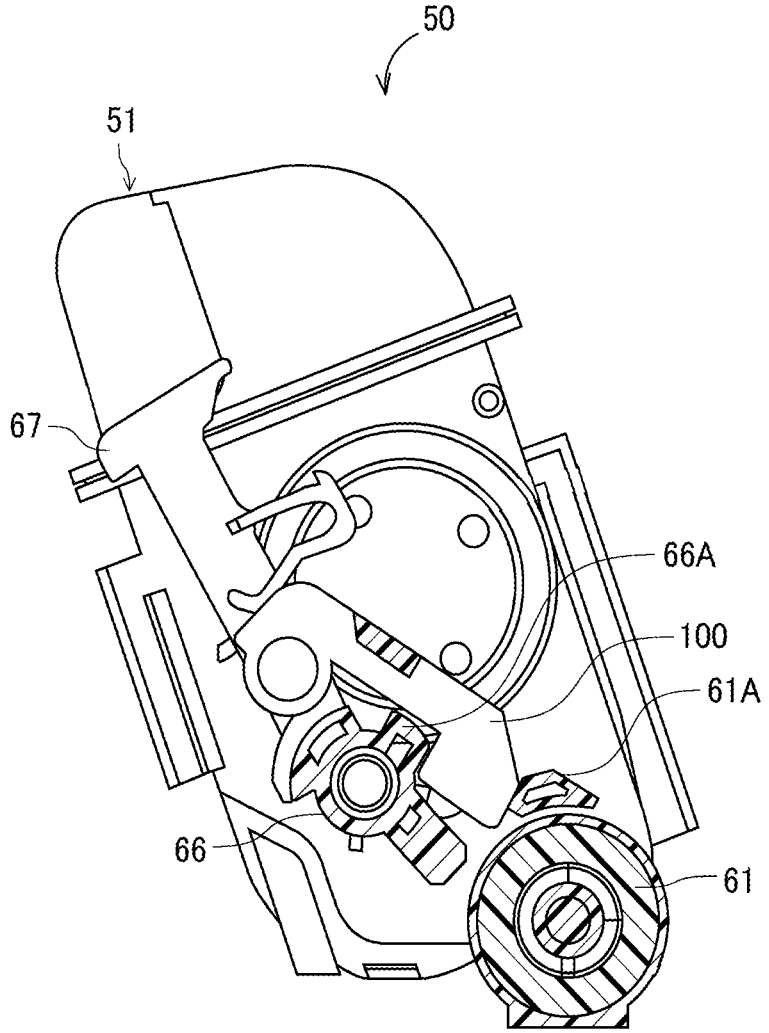
FIG. 24 is a partially broken view of a modification of the toner container.

According to the present embodiment, as shown in FIGS. 23 and 24, when the operation portion 54 and the opening/closing mechanism 53 are in the lock state, the lower portion of the lock member 100 is sandwiched by a projecting portion 66A and the first engaged portion 61A, wherein the projecting portion 66A is integrally formed with the shaft 66 and the first engaged portion 61A is integrally formed with the cylinder 61. In this state, the lock member 100 prohibits the shaft 66 from rotating clockwise in FIG. 24 and prohibits the cylinder 61 from rotating counterclockwise in FIG. 24. That is, by the lock member 100, the shaft 66 is restricted from rotating clockwise and the cylinder 61 is restricted from rotating counterclockwise. It is noted that the lock member 100 is configured to release the lock state of the operation portion 54 and the opening/closing mechanism 53 when it is slided upward in FIG. 24.

In the above-described embodiment, a configuration where the image forming apparatus 10 includes four toner containers 50 is described as an example. However, the present disclosure is applicable to a configuration where the image forming apparatus 10 includes one toner container 50.

In the above-described embodiment, a configuration where the lever 67 can be disposed at the third operation position is described as an example. However, the lever 67 may not necessarily be positioned at the third operation position.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner case comprising:

a case main body configured to be attached to and detached from an apparatus main body of an image forming apparatus and store toner;

a toner discharge outlet formed on the case main body;

an opening/closing member configured to open and close the toner discharge outlet and be moved between an opening position and a closing position;

a lever member configured to be operated between a first operation position and a second operation position such that the lever member at the first operation position allows the opening/closing member to be positioned at the closing position, and the lever member at the second operation position allows the opening/closing member to be positioned at the opening position;

a lock member configured to be moved between a lock position and an unlock position such that the lock member at the lock position abuts on both the opening/closing member and the lever member, locks the opening/closing member to the closing position and locks the lever member to the first operation position, and the lock member at the unlock position is separated from both the opening/closing member and the lever member and allows the opening/closing member and the lever member to be released from respective locks;

a first extended portion provided on the lever member and extending in a pivoting direction of the lever member; and a second extended portion provided on the lock member and configured to be elastically deformed in a diameter direction of an arcing trajectory drawn by the first extended portion when the first extended portion is displaced as the lever member pivots, rigidity of the second extended portion being higher in a direction along the trajectory than in the diameter direction, wherein when the case main body is in an attached attitude where the case main body is attached to the apparatus main body, the lock member is positioned at the unlock position, and when the case main body is in an unattached attitude where the case main body is not attached to the apparatus main body, the lock member is positioned at the lock position, the opening/closing member includes a first engaged portion and is configured to open and close the toner discharge outlet by pivoting around a predetermined first pivotal axis, the lock member includes a first engaging portion and a second engaging portion and is axially supported so as to pivot around a second pivotal axis that is parallel to the first pivotal axis, the lever member includes a second engaged portion and is axially supported by a side wall of the case main body so as to pivot around a third pivotal axis that is parallel to the first pivotal axis, when the lock member is positioned at the lock position, the first engaging portion is engaged with the first engaged portion so as to lock the opening/closing member to the closing position, and when the lock member is pivoted from the lock position to the unlock position, the first engaging portion is separated from the first engaged portion and is released from an engagement with the first engaged portion so as to release the opening/closing member from a lock, when the lock member is positioned at the lock position, the second engaging portion is engaged with the second engaged portion so as to lock the lever member to the first operation position, and when the lock member is pivoted from the lock position to the unlock position, the second engaging portion is separated from the second engaged portion and is released from an engagement with the second engaged portion so as to release the lever member from a lock, and when the lever member is pivoted in a state where the lock member is positioned at the unlock position, the second extended portion slides on the first extended portion while being deformed in the diameter direction upon receiving a force from the first extending portion.

2. The toner case according to claim 1, wherein when the case main body is in the attached attitude, the lever member is coupled with the opening/closing member via a drive transmission mechanism provided in the apparatus main body such that a driving force that is input by an operation of the lever member, is transmitted from the drive transmission mechanism to the opening/closing member.

3. The toner case according to claim 1, wherein the lock member includes an arm portion that extends from the second pivotal axis in a direction perpendicular to the second pivotal axis, and the first engaging portion and the second engaging portion are provided in the arm portion.

4. The toner case according to claim 1, wherein the lock member is positioned above the opening/closing member when the case main body is in the attached attitude, the first engaged portion is a projection in a shape of a claw and includes an engaged surface, the first engaging portion is a projection in a shape of a claw and includes an engaging surface that is configured to be engaged with the engaged surface, the first engaged portion and the first engaging portion are engaged with each other in a state where: a tip of the first engaged portion in a projection direction thereof makes a point contact with the engaging surface; and a predetermined angle is formed between the engaged surface and the engaging surface.

5. The toner case according to claim 1, wherein the second engaged portion is engaged with the second engaging portion at a position closer to the third pivotal axis than an engagement position at which the first engaged portion is engaged with the first engaging portion.

6. The toner case according to claim 1, wherein the first pivotal axis is coaxially arranged with a rotational axis of a conveyance member that conveys toner in the case main body toward the toner discharge outlet, and the third pivotal axis is coaxially arranged with a rotational axis of a stirring member that stirs the toner in the case main body.

7. The toner case according to claim 1, wherein the lock member includes a pressed portion that receives a force from a predetermined pressing piece provided in the apparatus main body during a process where the case main body is attached to the apparatus main body, and upon receiving the force, presses the lock member from the lock position to the unlock position.

8. The toner case according to claim 7, wherein the opening/closing member and the lever member are provided on a side surface of the case main body, the toner case further comprises a cover member configured to axially support the lock member between the cover member itself and the side surface of the case main body and cover the side surface, and the cover member includes an insertion hole through which the pressed portion is exposed to outside, and when the case main body is attached to the apparatus main body, the pressing piece of the apparatus main body is inserted through the insertion hole and presses the pressed portion to the unlock position.

9. The toner case according to claim 8, wherein the pressing piece has a shape of a plate with a narrow width, and the insertion hole has a narrow width so that the pressing piece can be inserted through the insertion hole.

10. The toner case according to claim 1, wherein the second extended portion includes an elastic deformation portion and a slidably contacting portion, the elastic deformation portion extending out from a main body of the lock member such that the elastic deformation portion can be deformed in the diameter direction, the slidably contacting portion being formed on a free end of the elastic deformation portion, and with a movement of the lock member toward the unlock position, the slidably contacting portion enters the trajectory.

11. The toner case according to claim 10, wherein the slidably contacting portion has inclined portions respectively at opposite sides thereof in the direction along the trajectory, the inclined portions being inclined with respect to a pivoting direction of the first extended portion, and the first extended portion slides on the inclined portions until the first extended portion is in contact with an end portion of the slidably contacting portion in the diameter direction.

12. The toner case according to claim 11, wherein the slidably contacting portion has a shape of a trapezoid in a cross section taken along a plane perpendicular to the first pivotal axis, and the inclined portions respectively correspond to opposite sides not parallel to each other, among four sides of the trapezoid.

13. The toner case according to claim 11, wherein the slidably contacting portion has a shape of a triangle in a cross section taken along a plane perpendicular to the first pivotal axis, and the inclined portions respectively correspond to two sides of the triangle.

14. The toner case according to claim 1, wherein the lever member is configured to be positioned at a third operation position that is provided at an opposite side of the second operation position across the first operation position in the direction along the trajectory.

15. An image forming apparatus comprising:

an apparatus main body; and the toner case according to claim 1 configured to be attached to and detached from the apparatus main body, wherein the apparatus main body includes a drive transmission mechanism configured to transmit a driving force that is input by an operation of the lever member, to the opening/closing member when the toner case is attached to the apparatus main body.

* * * * *